US008816948B2

(12) United States Patent
Hosaka et al.

(10) Patent No.: US 8,816,948 B2
(45) Date of Patent: Aug. 26, 2014

(54) VIDEO PROCESSING CIRCUIT AND METHOD, LIQUID CRYSTAL DISPLAY APPARATUS, AND ELECTRONIC APPARATUS

(75) Inventors: Hiroyuki Hosaka, Matsumoto (JP); Hidehito Iisaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 350 days.

(21) Appl. No.: 12/941,277

(22) Filed: Nov. 8, 2010

(65) Prior Publication Data

US 2011/0109815 A1 May 12, 2011

(30) Foreign Application Priority Data

Nov. 12, 2009 (JP) ..... 2009-258795

(51) Int. Cl.
*G09G 3/36* (2006.01)

(52) U.S. Cl.
CPC ..... *G09G 3/3648* (2013.01); *G09G 2330/08* (2013.01); *G09G 2360/16* (2013.01)
USPC ..... 345/87

(58) Field of Classification Search
USPC ..... 345/87
See application file for complete search history.

(56) References Cited

U.S. PATENT DOCUMENTS 5,709,911 A * 1/1998 Onishi et al. ..... 428/1.2
5,750,213 A * 5/1998 Onishi et al. ..... 428/1.2
5,990,995 A * 11/1999 Ebihara et al. ..... 349/113
6,516,091 B1 * 2/2003 Nagarajan et al. ..... 382/173
6,775,031 B1 * 8/2004 Fujiwara ..... 358/2.1
7,397,457 B2 * 7/2008 Sugino et al. ..... 345/89
2008/0018630 A1 * 1/2008 Fujino ..... 345/205
2009/0243983 A1 * 10/2009 Ohashi et al. ..... 345/89

FOREIGN PATENT DOCUMENTS

CN 101231831 A 7/2008
CN 101546544 A 9/2009
EP 1225558 A1 * 7/2002 ..... G09G 3/36
JP A-2009-69608 4/2009

* cited by examiner

*Primary Examiner* — Sumati Lefkowitz
*Assistant Examiner* — Joseph Fox
(74) *Attorney, Agent, or Firm* — Oliff PLC

(57) ABSTRACT

The video processing circuit includes a boundary detection unit that detects a specific boundary, which is a part of a boundary of a first pixel for which an applied voltage designated by the video signal is less than a first voltage, and a second pixel for which the applied voltage is more than a second voltage larger than the first voltage, the specific boundary being determined by tilt azimuth of the liquid crystal, and a replacement unit that replaces an applied voltage to a liquid crystal element corresponding to the first pixel with a predetermined voltage from the applied voltage designated by the input video signal when the applied voltage designated by the video signal is less than a third voltage smaller than the first voltage with respect to the first pixel adjacent to the specific boundary.

13 Claims, 28 Drawing Sheets

FIG. 5A SCANNING LINE DRIVING CIRCUIT
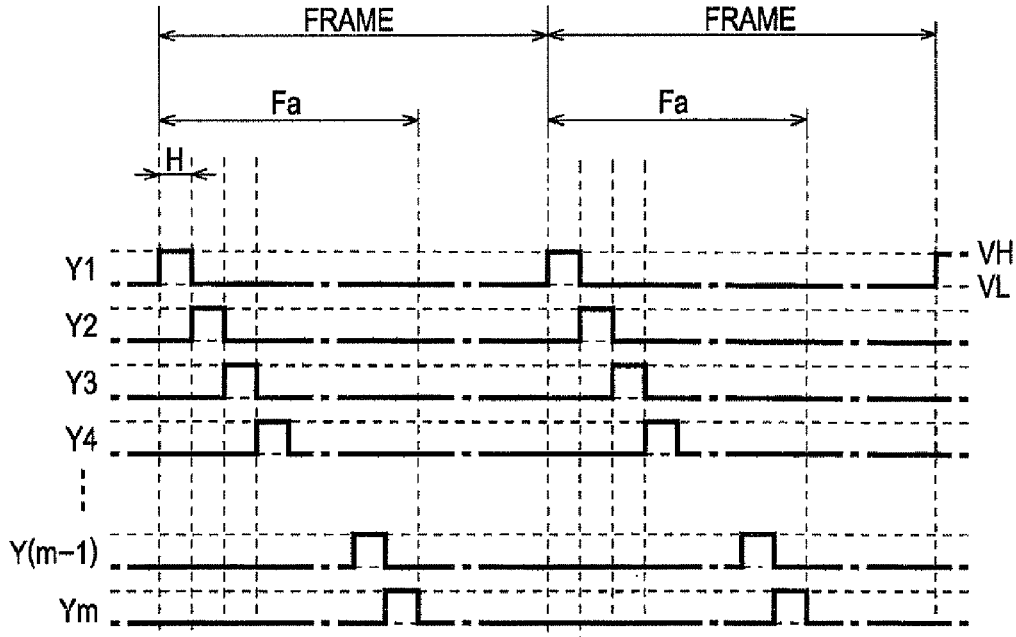
FIG. 5B VIDEO PROCESSING CIRCUIT
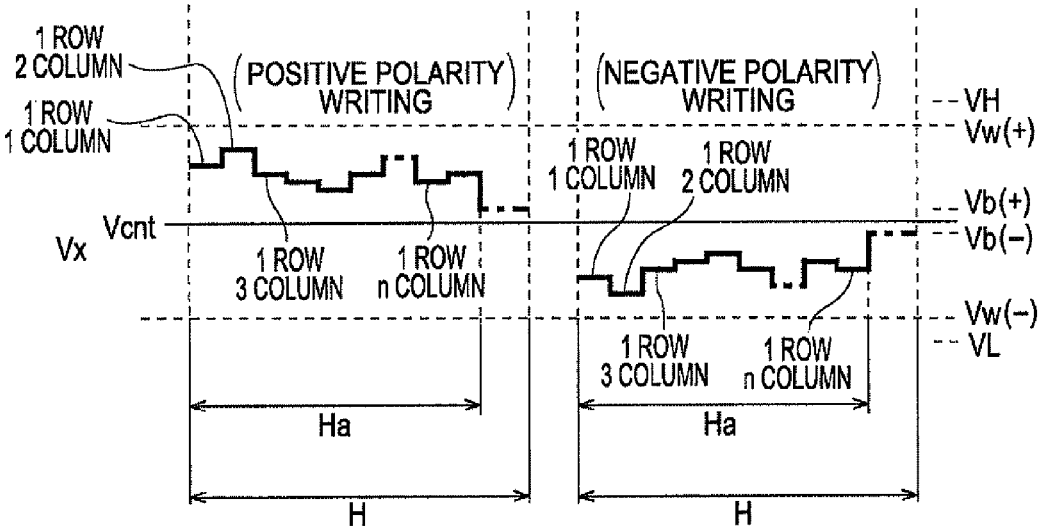

VIDEO SIGNAL (BEFORE PROCESSING)

BOUNDARY DETECTION

RISK BOUNDARY EXTRACTION

REPLACEMENT PROCESS (ONE PIXEL)

VIDEO SIGNAL (BEFORE PROCESSING)

BOUNDARY DETECTION

RISK BOUNDARY EXTRACTION

REPLACEMENT PROCESS (ONE PIXEL)

VIDEO SIGNAL (BEFORE PROCESSING)

BOUNDARY DETECTION

RISK BOUNDARY EXTRACTION

REPLACEMENT PROCESS (ONE PIXEL)

VIDEO SIGNAL (BEFORE PROCESSING)

BOUNDARY DETECTION

RISK BOUNDARY EXTRACTION

REPLACEMENT PROCESS (ONE PIXEL)

VIDEO SIGNAL (BEFORE PROCESSING)

BOUNDARY DETECTION

RISK BOUNDARY EXTRACTION

REPLACEMENT PROCESS (TWO PIXELS)

VIDEO SIGNAL (BEFORE PROCESSING)

BOUNDARY DETECTION

RISK BOUNDARY EXTRACTION

REPLACEMENT PROCESS (TWO PIXELS)

REDUCTION OF DISPLAY QUALITY DUE TO REVERSE TILT DOMAIN

VIDEO PROCESSING CIRCUIT AND METHOD, LIQUID CRYSTAL DISPLAY APPARATUS, AND ELECTRONIC APPARATUS

BACKGROUND

1. Technical Field

The present invention relates to a technology capable of reducing display faults in a liquid crystal panel.

2. Related Art

A liquid crystal panel has a configuration in which liquid crystal is interposed between a pair of substrates spaced apart from each other by a constant gap.

In detail, in the liquid crystal panel, liquid crystal is interposed between a first substrate, in which pixel electrodes are arranged for each pixel in a matrix shape, and a second substrate in which a common electrode is disposed in common over all pixels, and liquid crystal elements are formed of the pixel electrodes, the liquid crystal and the common electrode. In the liquid crystal element, if a voltage according to a grayscale level between the pixel electrodes and the common electrode is applied and held, an alignment state of the liquid crystal is specified for each pixel, so that transmittance or reflectivity is controlled. Thus, in the above configuration, it can be said that, among electric fields exerted on liquid crystal molecules, only a component in the direction toward the common electrode (or an opposite direction) from the pixel electrodes, that is, the vertical direction (the longitudinal direction) with respect to a substrate surface, contributes to display control.

By the way, as a pixel pitch is reduced along with recent miniaturization and high definition, since an electric field generated among adjacent pixel electrodes, that is, a transverse electric field is generated in the horizontal direction parallel to the substrate surface, the influence of the transverse electric field cannot be ignored. For example, if a transverse electric field is applied to liquid crystal of a vertical alignment (VA) mode, a twisted nematic (TN) mode and the like to be driven by a longitudinal electric field, since alignment failure (reverse tilt) of the liquid crystal occurs, display faults may occur.

In this regard, for example, there has been proposed a technology for analyzing video signals to determine images in which the reverse tilt may easily occur, and uniformly clipping video signals of a set value or more to adjust an applied voltage of a liquid crystal element when the images have been determined (for example, refer to JP-A-2009-69608, FIG. 2).

However, in the above technology, since video signals need to be analyzed for each frame, this may cause an increase in the scale and complexity of a video processing circuit.

SUMMARY

An advantage of some aspects of the invention is to provide a technology capable of preventing an increase in scale and complexity and the like of a video processing circuit and reducing the occurrence of display faults caused by reverse tilt domain.

According to one aspect of the invention, there is provided a video processing circuit, which includes a liquid crystal panel provided with pixel electrodes provided on a first substrate, a common electrode provided on a second substrate, and liquid crystal elements having liquid crystal interposed between the pixel electrodes and the common electrode, and designates an applied voltage, which is applied to the liquid crystal elements, to the liquid crystal panel based on a video signal, including: a boundary detection unit that detects a specific boundary (a risk boundary), which is a part of a boundary of a first pixel for which an applied voltage designated by the video signal is less than a first voltage, and a second pixel for which the applied voltage is more than a second voltage larger than the first voltage, the specific boundary being determined by tilt azimuth of the liquid crystal; and a replacement unit that replaces an applied voltage to a liquid crystal element corresponding to the first pixel with a predetermined voltage from the applied voltage designated by the input video signal when the applied voltage designated by the video signal is less than a third voltage which is smaller than the first voltage with respect to the first pixel adjacent to the specific boundary. According to one aspect of the invention, since only a process for detecting the boundary and the specific boundary among pixels, rather than the entire image corresponding to one frame, is performed, an increase in the scale and complexity of the video processing circuit can be prevented, as compared with the configuration in which an image corresponding to two frames or more is analyzed and the movement of the image is detected.

According to a further aspect of the invention, preferably, the tilt azimuth is a direction toward the other end of a liquid crystal molecule from one end of a long axis of the liquid crystal molecule at a side of the pixel electrodes when viewed in a plan view toward the common electrode from the side of the pixel electrodes. This is because reverse tilt domain is caused by a transverse electric field generated among pixel electrodes.

In addition, according to a further aspect of the invention, the selection of the predetermined voltage is determined according to the priority. However, if priority is given to the point that a change in transmittance (reflectivity) due to replacement is not recognized, the predetermined voltage is preferably the third voltage.

According to a further aspect of the invention, the boundary detection unit may detect the boundary by comparing an input video signal with a signal obtained by delaying the input video signal by one pixel. With such a configuration, the simplification of the configuration can be further achieved.

According to a further aspect of the invention, when an applied voltage designated by a video signal of the pixel is less than the third voltage with respect to one or more pixels which are adjacent at an opposite side of the risk boundary with respect to the first pixel adjacent to the specific boundary and continuous toward a direction opposite to that of the specific boundary, the replacement unit may replace an applied voltage to a liquid crystal element corresponding to the pixel with the third voltage from the applied voltage designated by the video signal. With such a configuration, even when a response time of a liquid crystal element is longer than a time interval in which a display screen is updated, the occurrence of reverse tilt domain can be prevented.

In detail, when a time interval in which the display of the liquid crystal panel is updated is defined as S and a response time of the liquid crystal element when an applied voltage is switched to the third voltage from a voltage less than the third voltage is defined as T, if $S<T$, the number of one or more pixels, which are adjacent at an opposite side of the specific boundary with respect to the first pixel adjacent to the specific boundary and continuous toward a direction opposite to that of the specific boundary, may have a value of an integer part of a value obtained by dividing the response time T by the time interval S. If such a value is employed, it is not necessary to replace a grayscale designated by a video signal Vid-in, and the unstable state of liquid crystal molecules can be prevented from being continuous even at the time of the next update (rewriting).

According to a further aspect of the invention, the third voltage is a voltage which is enough to give an initial inclination angle to liquid crystal element. Preferably, the third voltage is about 1.5V.

The invention can be applied to a video processing method, a liquid crystal display apparatus, and an electronic apparatus including the liquid crystal display apparatus, in addition to a video processing circuit.

BRIEF DESCRIPTION OF THE DRAWINGS

The invention will be described with reference to the accompanying drawings, wherein like numbers reference like elements.

FIGS. 5A and 5B are diagrams showing a display operation in the liquid crystal panel.

DESCRIPTION OF EXEMPLARY EMBODIMENTS

Embodiment

Hereinafter, an embodiment of the present invention will be described with reference to the accompanying drawings.

Figure 1:
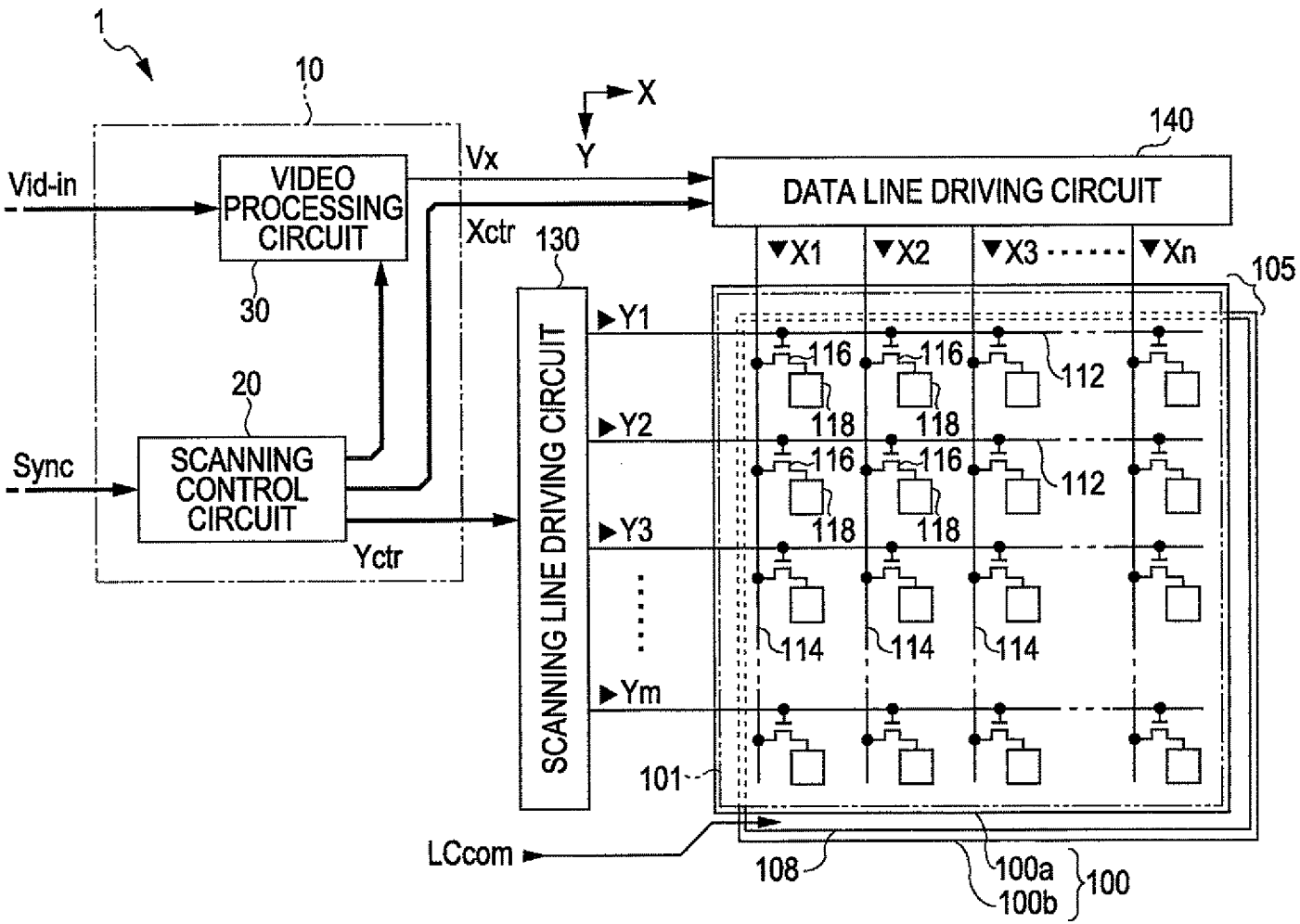
FIG. 1 is a diagram showing a liquid crystal display apparatus to which a video processing circuit according to a first embodiment is applied.

FIG. 1 is a block diagram showing the entire configuration of a liquid crystal display apparatus to which a video processing circuit according to the embodiment is applied.

As shown in FIG. 1, the liquid crystal display apparatus 1 includes a control circuit 10, a liquid crystal panel 100, a scanning line driving circuit 130, and a data line driving circuit 140.

Among them, the control circuit 10 receives video signals Vid-in from an upper apparatus in synchronization with a synchronization signal Sync. The video signals Vid-in are digital data for designating grayscale levels of each pixel in the liquid crystal panel 100, and are supplied in a scanning sequence according to a vertical scanning signal, a horizontal scanning signal and a dot clock signal (not shown) included in the synchronization signal Sync.

In addition, since the video signals Vid-in designate the grayscale levels but an applied voltage of a liquid crystal element is determined according to the grayscale levels, it is safe to say that the video signals Vid-in designate the applied voltage of the liquid crystal element.

The control circuit 10 includes a scanning control circuit 20 and a video processing circuit 30. Between them, the scanning control circuit 20 generates various control signals and controls each part in synchronization with the synchronization signal Sync. The video processing circuit 30 processes the digital video signals Vid-in to output analog data signals Vx, which will be described in detail.

The liquid crystal panel 100 has a configuration in which an element substrate (a first substrate) 100*a* and an opposite substrate (a second substrate) 100*b* are stuck to each other while being spaced apart from each other by a predetermined gap, and liquid crystal 105 driven by a longitudinal electric field is interposed into the gap.

On the surface of the element substrate 100*a* facing the opposite substrate 100*b*, a plurality of m rows of scanning lines 112 are provided along the horizontal direction X in FIG. 1 and a plurality of n columns of data lines 114 are provided along the vertical direction Y. The scanning lines 112 are electrically isolated from the data lines 114, respectively.

In addition, in this embodiment, in order to distinguish the scanning lines 112 from one another, a case may occur in which the scanning lines 112 are called $1^{st}$, $2^{nd}$, $3^{rd}$, . . . , $(m-1)^{th}$ and $M^{th}$ rows from the top in order in FIG. 1. Similarly to this, in order to distinguish the data lines 114 from another, a case may occur in which the data lines 114 are called $1^{st}$, $2^{nd}$, $3^{rd}$, . . . , $(n-1)^{th}$ and $n^{th}$ columns from the left in order in FIG. 1.

In addition, in the element substrate 100*a*, pairs of n channel TFT 116*s* and pixel electrodes 118 having a rectangular shape and transparency are provided in correspondence with each intersection of the scanning lines 112 and the data lines 114. Each TFT 116 has a gate electrode connected to the scanning line 112, a source electrode connected to the data line 114, and a drain electrode connected to the pixel electrode 118.

Meanwhile, on the surface of the opposite substrate 100*b* facing the element substrate 100*a*, a common electrode 108 having transparency is provided over the whole surface thereof. A voltage LCcom is applied to the common electrode 108 by a circuit (not shown).

In addition, in FIG. 1, since the surface of the element substrate 100*a* facing the opposite substrate 100*b* corresponds to the reverse side, the scanning lines 112, the data lines 114, the TFTs 116 and the pixel electrodes 118, which are provided on the surface of the element substrate 100*a*, should be indicated by broken lines, respectively. However, if so, observation becomes difficult, therefore they are indicated by solid line, respectively.

Figure 2:
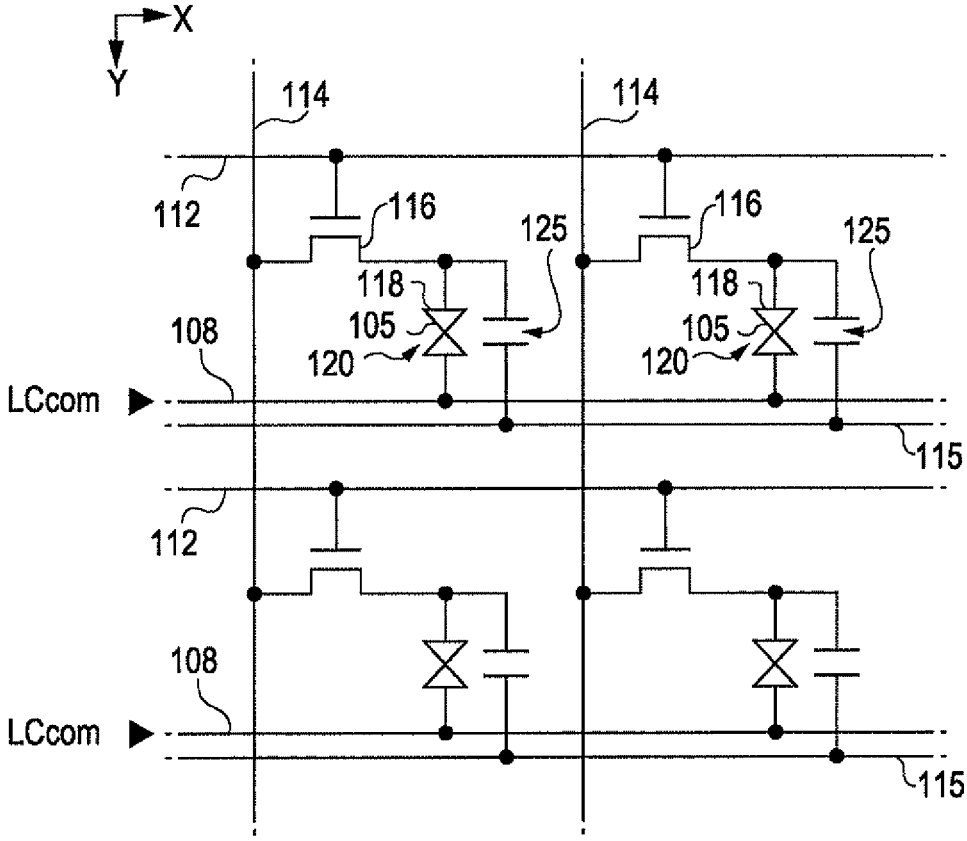
FIG. 2 is a diagram showing an equivalent circuit of a liquid crystal element in the liquid crystal display apparatus.

An equivalent circuit in the liquid crystal panel 100 is shown in FIG. 2, and has a configuration in which liquid crystal elements 120 including the liquid crystal 105 interposed between the pixel electrodes 118 and the common electrode 108 are arranged in correspondence with each intersection of the scanning lines 112 and the data lines 114.

Furthermore, although not shown in FIG. 1, the equivalent circuit in the liquid crystal panel 100 actually includes auxiliary capacitors (accumulation capacitors) 125 provided in parallel to the liquid crystal elements 120, respectively, as shown in FIG. 2. Each auxiliary capacitor 125 has one end connected to the pixel electrode 118 and the other end connected to a capacitor line 115. The capacitor line 115 is temporally maintained at a constant voltage.

With such a configuration, if the scanning lines 112 are at a high level, the TFTs 116 having the gate electrode connected to the scanning line are turned on, so that the pixel electrodes 118 are connected to the data lines 114, respectively. Thus, when the scanning lines 112 are at the high level, if a data signal of a voltage according to a grayscale is supplied to the data lines 114, the data signal is applied to the pixel electrodes 118 through the turned-on TFTs 116 which. If the scanning lines 112 are at a low level, the TFTs 116 are turned off, but the voltage applied to the pixel electrodes is sustained by the capacity performance of the liquid crystal elements 120 and the auxiliary capacitors 125.

As is well known in the art, in the liquid crystal elements 120, the alignment state of the liquid crystal 105 is changed according to an electric field generated by the pixel electrodes 118 and the common electrode 108. Therefore, if the liquid crystal elements 120 are transmission type elements, the liquid crystal elements 120 have transmittance according to the applied/sustained voltage.

In the liquid crystal panel 100, since transmittance is changed according to each liquid crystal element 120, the liquid crystal elements 120 correspond to pixels, respectively. An arrangement area of the pixels serves as a display area 101. In addition, in this embodiment, the liquid crystal 105 of the VA mode is employed, that is, a normally black mode is used, in which transmittance of the liquid crystal elements 120 corresponds to the lowest black state when no voltage is applied.

The scanning line driving circuit 130 supplies scanning signals Y1, Y2, Y3, . . . , Ym to the scanning lines 112 of $1^{st}$, $2^{nd}$, $3^{rd}$, . . . , $m^{th}$ over a frame according to a control signal Yctr output from the scanning control circuit 20. In detail, as shown in FIG. 5A, the scanning line driving circuit 130 selects the scanning lines 112 in the sequence of $1^{st}$, $2^{nd}$, $3^{rd}$, . . . , $m^{th}$ rows. Furthermore, the scanning line driving circuit 130 sets a scanning signal to the selected scanning line VH (high level) to a selection voltage VH (high level), and sets scanning signals to other scanning lines to a non-selection voltage VL (low level).

In addition, a frame represents a period at which a video signal Vid-in corresponding to one coma is supplied. If a vertical scanning signal included in the synchronization signal Sync has a frequency of 60 Hz, the frame corresponds to 16.7 milliseconds which are the reciprocal of the frequency. In this embodiment, since the scanning lines 112 of $1^{st}$, $2^{nd}$, $3^{rd}$, . . . , $m^{th}$ are sequentially selected over the frame, the liquid crystal panel 100 and the video signal Vid-in are driven at a constant speed. Thus, in this embodiment, a time required for displaying an image corresponding to one coma on the liquid crystal panel 100 coincides with the frame.

The data line driving circuit 140 samples the data signals Vx, which are supplied from the video processing circuit 30, along the data lines 114 of $1^{st}$ to $n^{th}$ columns as data signals X1 to Xn according to a control signal Xctr output from the scanning control circuit 20.

In addition, in accordance with the embodiment of the invention, in terms of the voltage, except for the applied voltage of the liquid crystal element 120, a ground voltage (not shown) is taken as a reference of voltage zero if there is no specific limitation. The applied voltage of the liquid crystal element 120 is the potential difference between the voltage LCcom of the common electrode 108 and the pixel electrodes 118, and is used to be distinguished from other voltages.

Furthermore, in order to prevent the deterioration of the liquid crystal 105 due to the application of a DC component, AC driving is performed with respect to the liquid crystal element 120. In detail, a high potential-side positive polarity voltage and a low potential-side negative polarity voltage with respect to a voltage Vcnt serving as the amplitude center are applied to the pixel electrode 118, for example, they are applied to the pixel electrode 118 while being alternately switched for each frame. In relation to such AC driving, this embodiment employs surface inversion in which all the writing polarities of the liquid crystal elements 120 are made to be equal to one another in the same frame.

In addition, it is considered that the voltage LCcom applied to the common electrode 108 is approximately the same as the voltage Vcnt. However, a case may occur in which the voltage LCcom is adjusted to be lower than the voltage Vcnt in consideration of the off-leak of the n channel TFT 116, that is, push-down and the like.

Figure 4A:
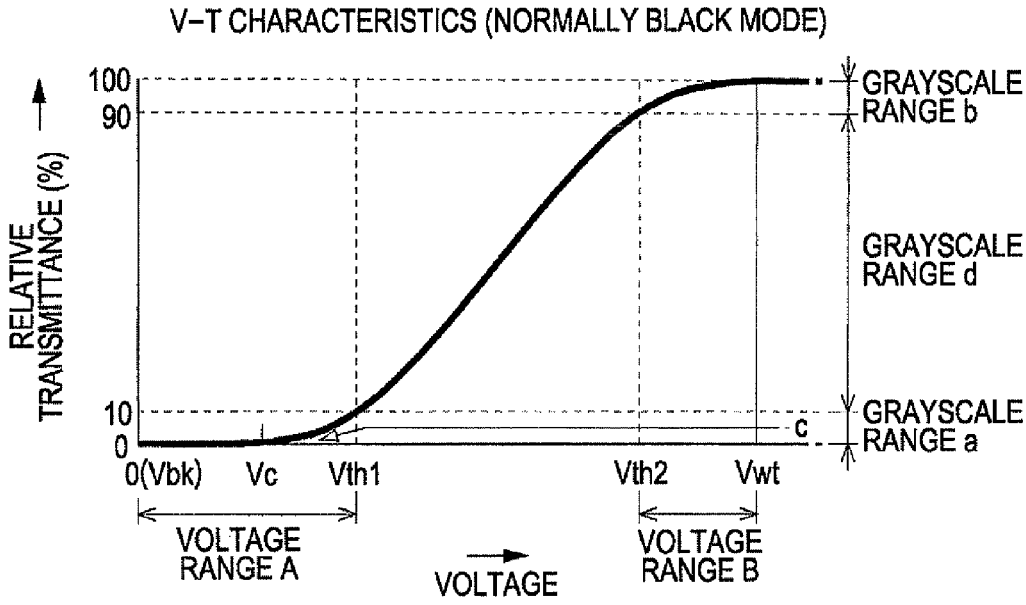
FIGS. 4A and 4B are diagrams showing V-T characteristics of a liquid crystal panel constituting the liquid crystal display apparatus.

Moreover, in this embodiment, the relationship between the applied voltage and the transmittance of the liquid crystal element 120 is indicated by V (voltage)-T (transmittance) characteristics as shown in FIG. 4A in the case of a normally black mode. Thus, in order to allow the liquid crystal element 120 to have transmittance according to the grayscale designated by the video signal Vid-in, it is preferred to apply a voltage according to the grayscale to the liquid crystal element.

However, when the applied voltage of the liquid crystal element 120 is simply specified according to the grayscale designated by the video signal Vid-in, display faults may occur due to reverse tilt domain.

An example of the display faults caused by the reverse tilt domain will be described. For example, as shown in FIG. 28, in relation to an image represented by the video signal Vid-in, when a black pattern including continuous black pixels moves in the right direction by one pixel for each frame on the background of white pixels, a pixel to be changed from a black pixel to a white pixel at the left end edge (the rear edge of movement) of the black pattern is not changed to the white pixel due to the occurrence of the reverse tilt domain, which is called a kind of tailing phenomenon.

In addition, as with this embodiment, in the case in which the liquid crystal panel 100 is driven at a speed the same as a supply speed of the video signal Vid-in, when a black pixel area moves by two pixels or more for each frame on the background of white pixels, if a response time of a liquid crystal element is shorter than an update time interval of a display screen as will be described later, such tailing phenomenon does not occur (or is invisible). The reason for this is as follows. That is, when white pixels and black pixels are adjacent to each other in a certain frame, it is probable that the reverse tilt domain will occur in the white pixels. However, when considering the movement of images, since pixels in which the reverse tilt domain occurs are discrete, it is considered that the tailing phenomenon is not visibly seen.

Figure 28:
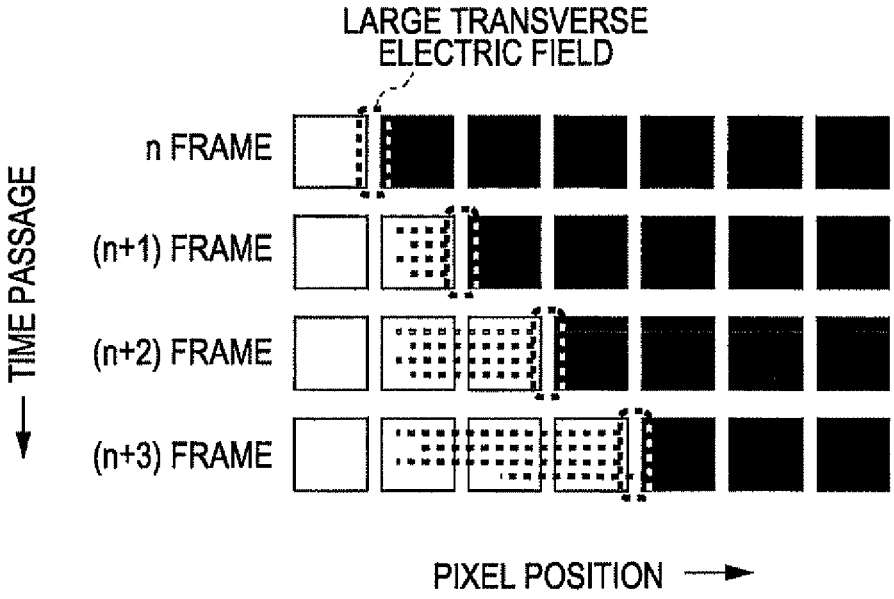
FIG. 28 is a diagram showing display faults and the like due to the influence of a transverse electric field.

In addition, when changing the viewpoint in FIG. 28, when a white pattern including continuous white pixels moves in the right direction by one pixel for each frame on the background of black Pixels, it can be said that a pixel to be changed from a black pixel to a white pixel at the right end edge (the front edge of movement) of the white pattern is not changed to the white pixel due to the occurrence of the reverse tilt domain.

Furthermore, in FIG. 28, for the purpose of convenience, the vicinity of the boundary of one line is extracted from the image.

One factor of the display faults caused by the reverse tilt domain is that: when liquid crystal molecules interposed in the liquid crystal element 120 are changed from an unstable state to an alignment state according to the applied voltage by the movement of the image, the alignment of the liquid crystal molecules is disordered by the influence of a transverse electric field, and then the liquid crystal molecules do not easily enter the alignment state according to the applied voltage.

Herein, in the case in which the influence of the transverse electric field is exerted, the voltage difference among adjacent pixel electrodes is large. This represents the case in which dark pixels at a black level (a level near the black level) in an image to be displayed are adjacent to bright pixels at a white level (or a level near the white level).

Between them, the dark pixels indicate pixels of the liquid crystal element 120 in which an applied voltage is equal to or more than a black level voltage Vbk in the normally black mode and is in the voltage range A less than a threshold value Vth1 (a first voltage). Furthermore, for descriptive purposes, a transmittance range (a grayscale range) of a liquid crystal element in which the applied voltage is in the voltage range A will be referred to as 'a'.

Next, the bright pixels indicate pixels of the liquid crystal element 120 in which an applied voltage is equal to or more than a threshold value Vth2 (a second voltage) and is in the voltage range B of a white level voltage Vwt which is equal to or less than in the normally black mode. For descriptive purposes, a transmittance range (a grayscale range) of a liquid crystal element in which the applied voltage is in the voltage range B will be referred to as 'b'.

In addition, in the normally black mode, the threshold value Vth1 may be an optical threshold voltage for allowing the relative transmittance of a liquid crystal element to be 10%, and the threshold value Vth2 may be an optical threshold voltage for allowing the relative transmittance of the liquid crystal element to be 90%.

Meanwhile, when the liquid crystal molecules are in an unstable state, the applied voltage of the liquid crystal element is less than Vc (a third voltage). When the applied voltage of the liquid crystal element is less than Vc, since a restraining force of a longitudinal electric field generated by the applied voltage is weaker than a restraining force due to an alignment layer, the alignment state of the liquid crystal molecules may be easily disordered by a minor external factor. Thereafter, when the applied voltage is equal to or more than Vc, even if the liquid crystal molecules are inclined according to the applied voltage, a response time is likely to be required. In other words, if the applied voltage is equal to or more than Vc, since the liquid crystal molecules start to be inclined according to the applied voltage (transmittance starts to change), it can be said that the alignment state of the liquid crystal molecules is in a stable state. In this regard, the voltage Vc is lower than the threshold value Vth1 specified by the transmittance.

In such a case, it can be said that pixels including the liquid crystal molecules in the unstable state before the change are in a situation where the reverse tilt domain may easily occur by the influence of a transverse electric field when dark pixels and bright pixels are adjacent to each other due to the movement of the image. However, when reviewing the case by considering an initial alignment state of the liquid crystal molecules, there are two cases in which the reverse tilt domain occurs or does not occur due to the positional relationship between the dark pixels and the bright pixels.

Next, the two cases will be reviewed respectively.

Figure 6A:
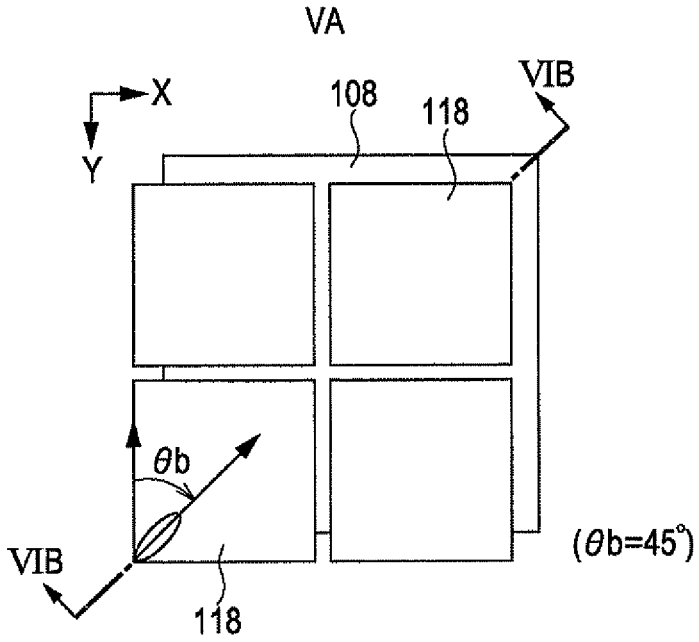
FIGS. 6A and 6B are diagrams explaining initial alignment when a VA mode is used in the liquid crystal panel.
Figure 6B:
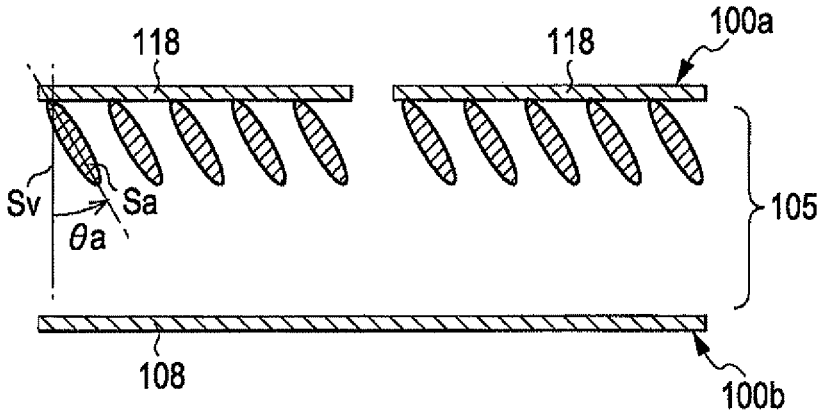

FIG. 6A shows (2×2) pixels adjacent to one another the vertical direction and the horizontal direction in the liquid crystal panel 100, and FIG. 6B is a simple sectional view of the liquid crystal panel 100 taken along a vertical surface including line VIB-VIB in FIG. 6A.

As shown in FIGS. 6A and 6B, when the potential difference (the applied voltage of the liquid crystal element) between the pixel electrodes 118 and the common electrode 108 is zero, the liquid crystal molecules of the VA mode are initially aligned at a tilt angle of θa and a tilt azimuth of θb (=45°).

Herein, since the reverse tilt domain occurs due to the transverse electric field among the pixel electrodes 118 as described above, the behavior of the liquid crystal molecules at the side of the element substrate 100*a* provided with the pixel electrodes 118 may be a problem. In this regard, the tilt azimuth and the tile angle of the liquid crystal molecules are specified by reference to the side of the pixel electrodes 118 (the element substrate 100*a*).

In detail, as shown in FIG. 6B, the tilt angle θa is an angle formed by a long axis Sa of the liquid crystal molecule when one end of the liquid crystal molecule located at the pixel electrode 118 is employed as a fixed point and the other end of the liquid crystal molecule located toward the common electrode 108 is inclined with respect to the normal Sv of the substrate.

Meanwhile, the tilt azimuth of θb is an angle formed by a substrate vertical surface (a vertical surface including line VIB-VIB) including the long axis Sa of the liquid crystal molecule and the normal Sv of the substrate when employing the substrate vertical surface along the direction, which is the alignment direction of the data lines 114, as a reference. In addition, the tilt azimuth of θb is an angle specified in the clockwise direction from the upper direction (the opposite direction of the Y direction) of the screen to the direction (the right upper direction in FIG. 6A) toward the other end of the long axis of the liquid crystal molecule starting from one end of the long axis of the liquid crystal molecule, when viewed in a plan view toward the common electrode 108 from the side of the pixel electrodes 118.

Furthermore, similarly to this, when viewed in a plan view from the side of the pixel electrodes 118, the direction toward the other end of the pixel electrode-side from one end of the pixel electrode-side in the liquid crystal molecule is called the downstream side of the tilt azimuth for descriptive purposes, and the direction (the left lower direction in FIG. 6A) toward one end thereof from the other end thereof is called the upstream side of the tilt azimuth for descriptive purposes.

Figures 7A, 7B, 7C:
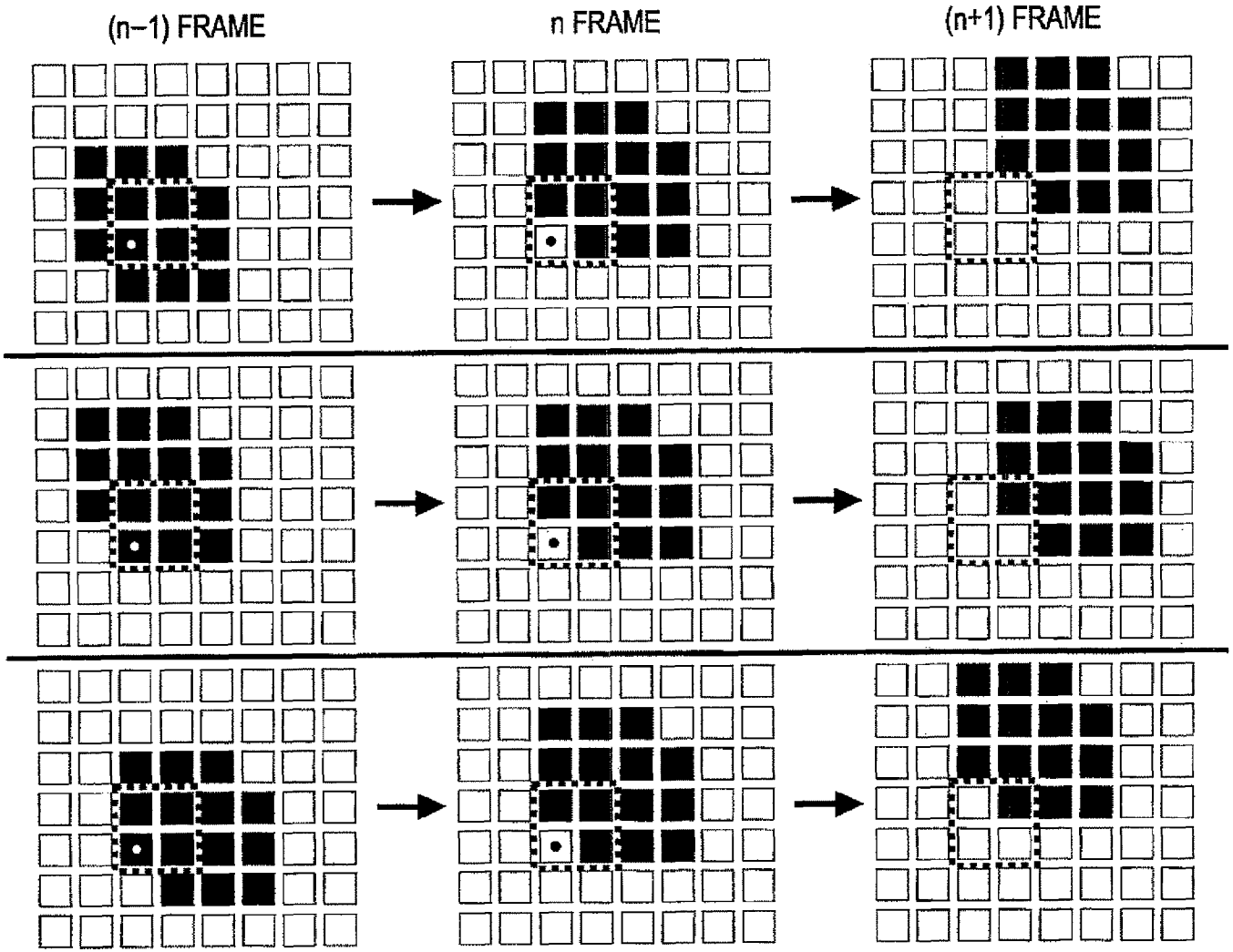
FIGS. 7A to 7C are diagrams explaining the movement of an image in the liquid crystal panel.

In the liquid crystal panel 100 using the liquid crystal 105 in the initial alignment state as described above, for example, as shown in FIG. 7A, four pixels of (2×2) surrounded by a broken line are focused upon. FIG. 7A shows the case in which a pattern including black level pixels (black pixels) moves in the right upper direction by one pixel for each frame on the background of an area including white level pixels (white pixels).

Figure 8A:
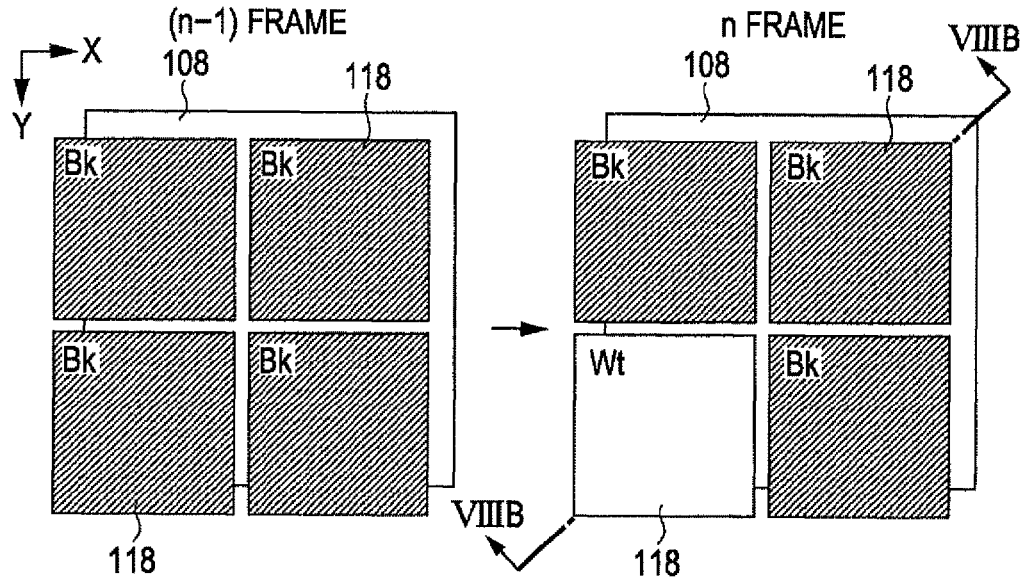
FIGS. 8A to 8C are diagrams explaining reverse tilt occurring in the liquid crystal panel.
Figure 8B:
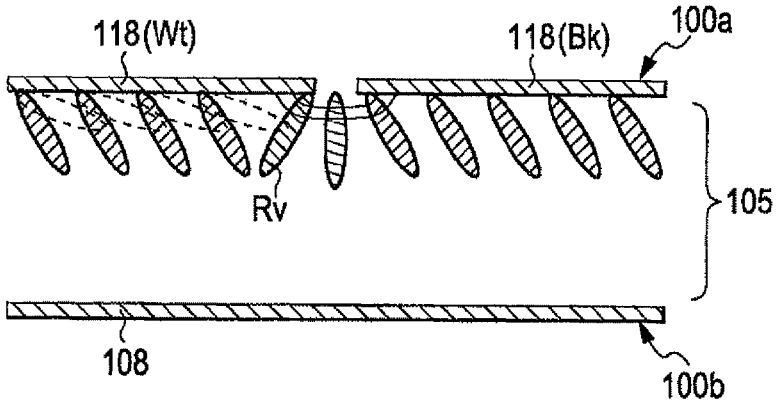

That is, as shown in FIG. 8A, it is assumed that only one pixel located at the left lower side of the four black pixels of (2×2) in the (n−1) frame is changed to a white pixel in the n frame. As described above, in the normally black mode, the applied voltage, which is the potential difference between the pixel electrodes 118 and the common electrode 108, is large at the white pixels as compared with the black pixels. Thus, at the left lower pixel changed from the black to the white, as shown in FIG. 8B, the liquid crystal molecule is changed from the state indicated by a solid line to the state indicated by a broken line, that is, the liquid crystal molecule is inclined in the direction (the horizontal direction of the substrate surface) perpendicular to the electric field direction.

However, the potential difference generated in the gap between the pixel electrodes 118 (Wt) of white pixels and the pixel electrodes 118 (Bk) of black pixels is approximately the same as the potential difference generated between the pixel electrodes 118 (Wt) of white pixels and the common electrode 108, and the gap between the pixel electrodes is narrower than the gap between the pixel electrodes 118 and the common electrode 108. Thus, in terms of electric field strength, the transverse electric field generated in the gap between the pixel electrodes 118 (Wt) and the pixel electrodes 118 (Bk) is stronger than the longitudinal electric field generated in the gap between the pixel electrodes 118 (Wt) and the common electrode 108.

Since the left lower pixel is a black pixel in which the liquid crystal molecule is in an unstable state in (n−1) frame, a time is required until the liquid crystal molecule is inclined according to the strength of the longitudinal electric field. Meanwhile, the transverse electric field from the adjacent pixel electrodes 118 (Bk) is stronger than the longitudinal electric field generated by applying the white level voltage to the pixel electrodes 118 (Wt). Consequently, at the pixel to be changed to the white, as shown in FIG. 8B, a liquid crystal molecule Rv adjacent to the black pixel is in a reverse tilt state ahead of other liquid crystal molecules to be inclined according to the longitudinal electric field.

Figure 8C:
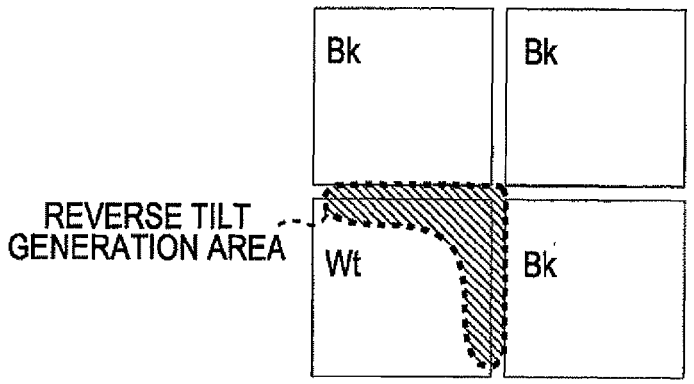

The liquid crystal molecule Rv in the reverse tilt state has an adverse influence on the movement of other liquid crystal molecules to be inclined in the horizontal direction of the substrate according to the longitudinal electric field as indicated by the broken line. In this regard, as shown in FIG. 8C, an area where the reverse tilt occurs in the pixel to be changed to the white is expanded to a wide range while encroaching upon the pixel to be changed to the white beyond the gap between the pixel to be changed to the white and the black pixels.

As described above, based on FIGS. 8A to 8*c*, in the case in which black pixels are located around a target pixel to be changed to the white, when the black pixels are adjacent to the right upper side, the right side and the upper side of the target pixel, it can be said that the reverse tilt occurs in the inner area of the target pixel along the right side and the upper side of the target pixel.

In addition, the change in the pattern as shown in FIG. 8A occurs in the case in which the pattern including the black pixels moves in the right direction by one pixel for each frame as shown in FIG. 7B, in the case in which the pattern including the black pixels moves in the upper direction by one pixel for each frame as shown in FIG. 7C, and the like, as well as the example as shown in FIG. 7A. Furthermore, as with the case in which the viewpoint is changed in the description of FIG. 28, the change in the pattern also occurs in the case in which the pattern including the white pixels moves in the right upper direction, the right direction or the upper direction by one pixel for each frame on the background of the area including the black pixels.

Figures 9A, 9B, 9C:
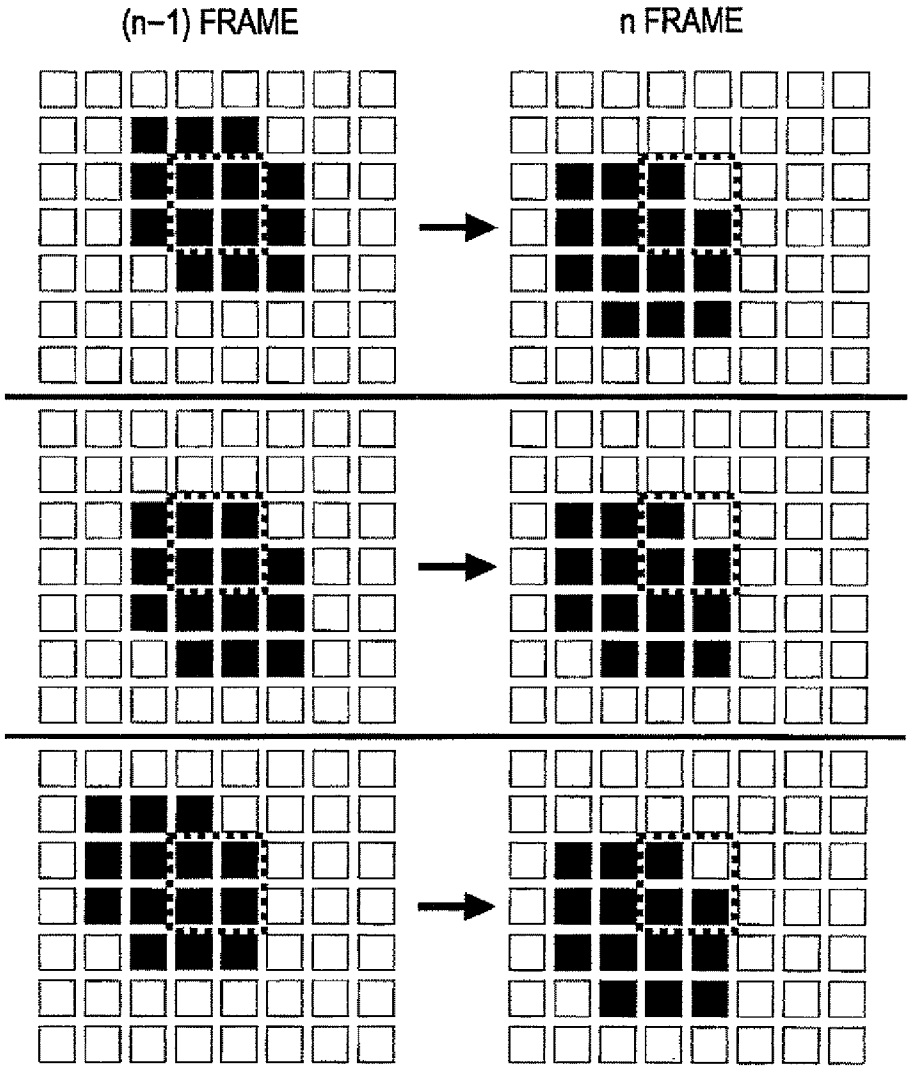
FIGS. 9A to 9C are diagrams explaining the movement of an image in the liquid crystal panel.

Next, in the liquid crystal panel 100, as shown in FIG. 9A, when a pattern including black pixels moves in the left lower direction by one pixel for each frame on the background of the area including white pixels, four pixels of (2×2) surrounded by a broken line are focused upon.

Figure 10A:
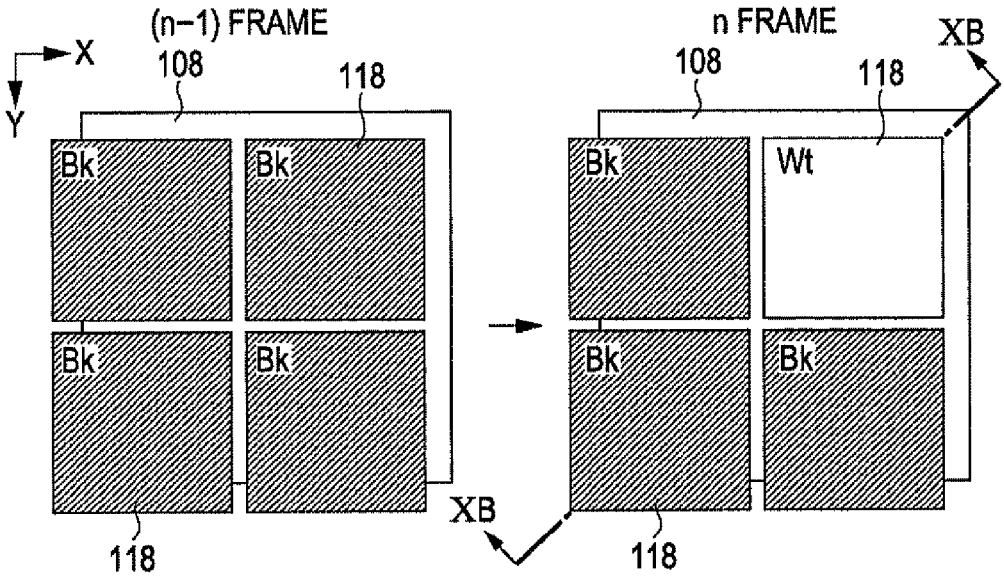
FIGS. 10A to 10C are diagrams explaining reverse tilt occurring in the liquid crystal panel.

That is, as shown in FIG. 10A, it is assumed that only one pixel located at the right upper side of the four black pixels of (2×2) in the (n−1) frame is changed to a white pixel in the n frame.

Figure 10B:
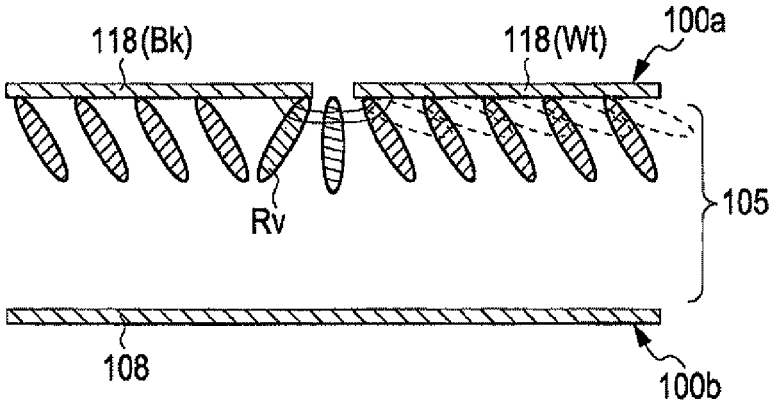
Figure 10C:
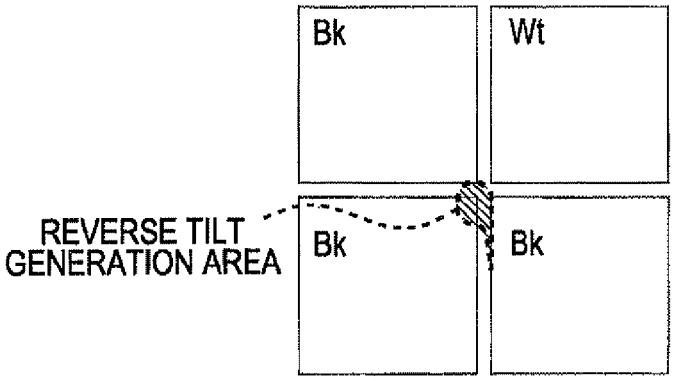

Even after the change, the transverse electric field stronger than the longitudinal electric field generated in the gap between the pixel electrodes 118 (Wt) and the common electrode 108 is generated in the gap between the pixel electrodes 118 (Bk) of the black pixels and the pixel electrodes 118 (Wt) of the white pixels. Due to the transverse electric field, as shown in FIG. 10B, the alignment state of a liquid crystal molecule Rv of the black pixel-side, which is adjacent to the white pixel, is changed ahead of other liquid crystal molecules to be inclined according to the longitudinal electric field, and enters a reverse tilt state. However, since the longitudinal electric field does not change from (n−1) frame at the black pixels, the liquid crystal molecule Rv rarely has an influence on other liquid crystal molecules. Thus, an area where the reverse tilt occurs at a pixel which is not changed from the black pixel is small enough to be ignored as shown in FIG. 10C as compared with the example of FIG. 8C.

Meanwhile, among the four pixels of (2×2), at the right upper pixel to be changed from the black to the white, since the initial alignment direction of the liquid crystal molecules is rarely affected by the transverse electric field, even if the longitudinal electric field is applied to the liquid crystal molecules, almost no liquid crystal molecules enter the reverse tilt state. Thus, the right upper pixel is changed to the white pixel as a target because the liquid crystal molecules are accurately inclined as indicated by the broken line of FIG. 10B in the horizontal direction with respect to the substrate surface with the increase in the strength of the longitudinal electric field, so that the deterioration of display quality does not occur.

In addition, the change in the pattern as shown in FIG. 10A occurs in the case in which the pattern including the black pixels moves in the left direction by one pixel for each frame as shown in FIG. 9B, in the case in which the pattern including the black pixels moves in the lower direction by one pixel for each frame as shown in FIG. 9C, and the like, as well as the example as shown in FIG. 9A. Furthermore, as with the case in which the viewpoint is changed in the description of FIG. 28, the change in the pattern also occurs in the case in which the pattern including the white pixels moves in the left lower direction, the left direction or the lower direction by one pixel for each frame on the background of the area including the black pixels.

From the descriptions of FIGS. 6A and 6B, 7A to 7C, 8A to 8C, 9A to 9C, and 10A to 10C, in the liquid crystal of the assumed VA mode (the normally black mode), when focusing on a certain n frame, if the following conditions are satisfied, it can be said that the next pixel in the n frame is affected by the reverse tilt domain.

(1) When focusing on the n frame, since a dark pixel is adjacent to a bright pixel, that is, a pixel with a low applied voltage is adjacent to a pixel with a high applied voltage, the transverse electric field is strong.

(2) In the n frame, the bright pixel (the applied voltage is high) is located at the left lower side, the left side or the lower side, which corresponds to the upstream side of the tilt azimuth in the liquid crystal molecules with respect to the adjacent dark pixel (the applied voltage is low).

(3) When the liquid crystal molecules of the pixel to be changed to the bright pixel in the n frame have been in an unstable state in the frame (the (n−1) frame) prior to one frame, the reverse tilt occurs in the bright pixel in the n frame.

In other words, the condition, in which the reverse tilt domain occurs in the bright pixel satisfying the positional relationship of the conditions (1) and (2) in the n frame, is the same as the condition (3) in which the liquid crystal molecules of the pixel to be changed to the bright pixel in the n frame have been in the unstable state in the frame (the (n−1) frame) prior to one frame.

Meanwhile, FIGS. 7A to 7C show an example in which the four pixels of (2×2) are the black pixels in the (n−1) frame and only the left lower one of the four pixels is changed to the white pixel in the (n+1) frame. However, in general, it is normal that the same movement is not only made in the (n−1) frame and the n frame but also a plurality of frames including the (n−1) frame and the n frame, which are located before and after the (n−1) frame and the n frame. Thus, as shown in FIGS. 7A to 7C, it is considered in many cases that the bright pixels are adjacent to the left lower side, the left side or the lower side of the dark pixel (the pixel with the white circle point), which include the liquid crystal molecules in the unstable state in the (n−1) frame, due to the movement of the image pattern.

Therefore, when dark pixels are adjacent to bright pixels in an image represented by the video signal Vid-in and the dark pixels are located at the right upper side, the right side or the upper side with respect to the bright pixels in the (n−1) frame, if liquid crystal elements corresponding to the dark pixels receive a voltage for preventing liquid crystal molecules from being in the unstable state, even if the conditions (1) and (2) are satisfied in the n frame due to the movement of the image pattern, since the condition (3) is not satisfied, the reverse tilt domain does not occur in the n frame.

Based on this fact, the n frame and the (n+1) frame will be considered. In the n frame, in the case in which dark pixels are adjacent to bright pixels in an image represented by the video signal Vid-in and the dark pixels are located at the right upper side, the right side or the upper side with respect to the bright pixels in the (n−1) frame, when taking measures for preventing liquid crystal molecules of liquid crystal elements corresponding to the dark pixels from being in the unstable state, even if the conditions (1) and (2) are satisfied in the (n+1) frame due to the movement of the image pattern by one pixel, the condition (3) is not satisfied. Consequently, it is possible to prevent the occurrence of the reverse tilt domain in the later (n+1) frame from the n frame.

Next, when dark pixels are adjacent to bright pixels in an image represented by the video signal Vid-in and the dark pixels have the above positional relationship to the bright pixels in the n frame, a preferred method for preventing liquid crystal molecules from being in the unstable state in the dark pixels will be considered. As described above, when the liquid crystal molecules are in the unstable state, the applied voltage of a liquid crystal element is less than Vc. Therefore, for the dark pixels satisfying the above positional relationship, if the applied voltage of a liquid crystal element designated by the video signal Vid-in is less than Vc, it is preferred to forcedly replace the applied voltage with a voltage equal to or more than Vc and apply the replaced voltage.

Next, a preferred replacement voltage will be considered. In the case in which the applied voltage designated by the video signal Vid-in is less than Vc, when a replacement voltage equal to or more than Vc is applied to the liquid crystal element, if priority is given to the point that the liquid crystal molecules are allowed to be in the stable state or the occurrence of the reverse tilt domain is prevented more reliably, it is preferred that the replacement voltage is high. However, in the case of the normally black mode, as the applied voltage of the liquid crystal element is increased, transmittance is increased. Since the grayscale designated by the original video signal Vid-in corresponds to a dark pixel, that is, low transmittance, increasing the replacement voltage may cause the display of an image which is not based on the video signal Vid-in.

Meanwhile, when the replacement voltage equal to or more than Vc is applied to the liquid crystal element, if priority is given to the point that a change in the transmittance is not recognized, the voltage Vc as a lower limit is preferred.

As described above, selection of the value of the replacement voltage is determined according to the priority. In this embodiment, since priority is given to the point that the change in the transmittance due to the replacement is not recognized, the voltage Vc is employed as the replacement voltage. However, if priority is given to the above-described points, the voltage Vc is not necessarily employed as the replacement voltage.

In addition, the liquid crystal molecules of the VA mode are the nearest to the vertical direction with respect to the substrate surface when the applied voltage of the liquid crystal element is zero. However, the voltage Vc is a voltage which is enough to give an initial inclination angle to the liquid crystal molecules, and the liquid crystal molecules start to be inclined as the voltage is applied thereto.

In general, the voltage Vc for allowing the liquid crystal molecules to be in the stable state is not indiscriminately determined because various parameters are included in the liquid crystal panel. However, as with this embodiment, in the liquid crystal panel in which the gap between the pixel electrodes 118 is narrower than the gap (a cell gap) between the pixel electrodes 118 and the common electrode 108, the voltage Vc is about 1.5 V.

Consequently, since 1.5 V is a lower limit of the replacement voltage, it can be said that voltages equal to or more than 1.5 V may be selected. In other words, if the applied voltage of the liquid crystal element is less than 1.5 V, the liquid crystal molecules may be in the unstable state.

Based on the above considerations, a circuit, which process the video signal Vid-in of the n frame and prevents the occurrence of the reverse tilt domain in the liquid crystal panel 100, is the video processing circuit 30 shown in FIG. 1. Next, the video processing circuit 30 will be described in detail.

Figure 3:
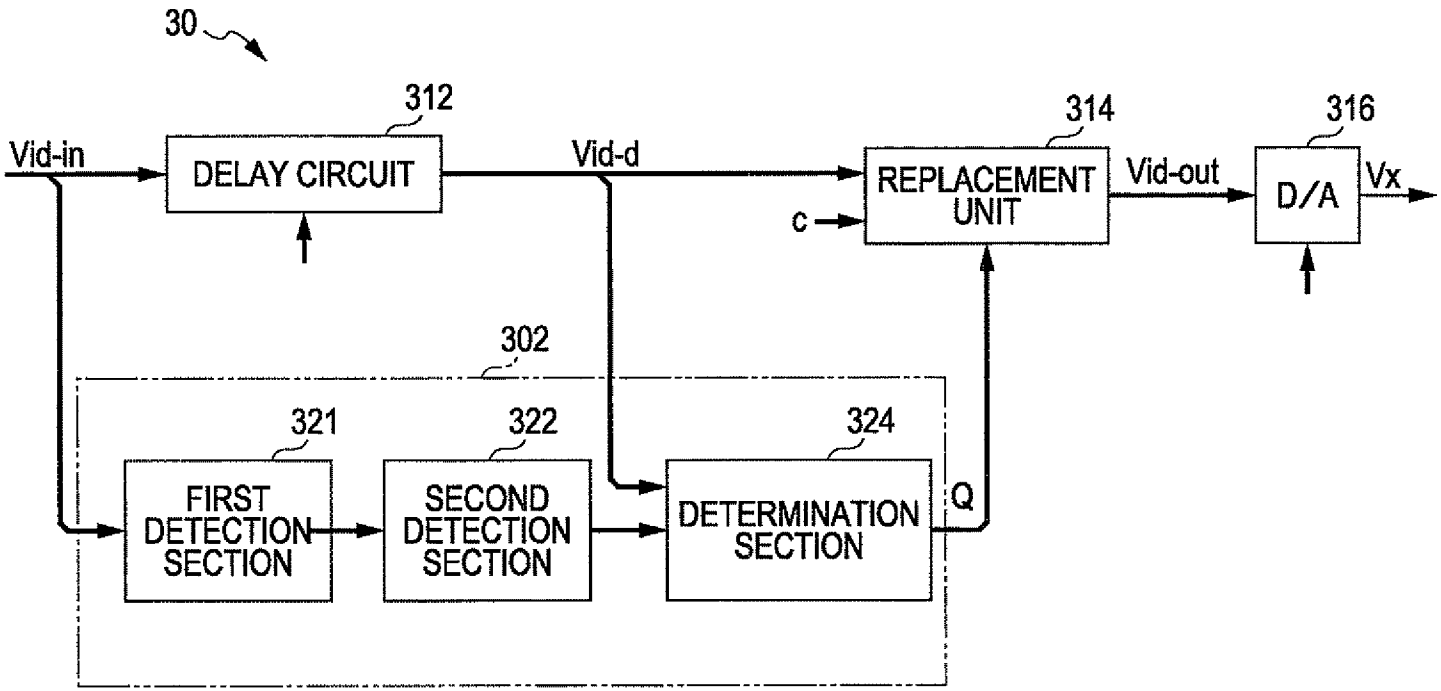
FIG. 3 is a diagram showing the configuration of a video processing circuit.

FIG. 3 is a block diagram showing the configuration of the video processing circuit 30. As shown in FIG. 3, the video processing circuit 30 includes a boundary detection unit 302, a delay circuit 312, a replacement unit 314 and a D/A converter 316.

Among them, the delay circuit 312 stores the video signal Vid-in supplied from the upper apparatus, reads the video signal Vid-in after a predetermined time lapses, and outputs a video signal Vid-d. The delay circuit 312 is formed of a FIFO (Fast In Fast Out) memory, a multi-step latch circuit and the like. In addition, the storage and reading by the delay circuit 312 are controlled by the scanning control circuit 20.

In this embodiment, the boundary detection unit 302 includes a first detection section 321, a second detection section 322, and a determination section 324.

Among them, the first detection section 321 analyzes an image represented by the video signal Vid-in, and determines the presence or absence of a part in which pixels in the grayscale range a and pixels in the grayscale range b are adjacent to each other in the vertical or horizontal direction. When it is determined that the adjacent part exists, the first detection section detects the adjacent part as a boundary and outputs the position information of the boundary.

In addition, the boundary mentioned here indicates a part in which dark pixels in the grayscale range a and bright pixels in the grayscale range b are adjacent to each other, that is, a part in which a strong transverse electric field is generated. Thus, for example, a part, in which the pixels in the grayscale range a and other pixels in the grayscale range d (refer to FIG. 4A), other than the grayscale ranges a and b, are adjacent to each other, or a part, in which the pixels in the grayscale range b and the pixels in the grayscale range d are adjacent to each other, is not treated as the boundary.

Next, the second detection section 322 extracts a part, in which dark pixels are located at the upper side and bright pixels are located at the lower side, and a part, in which the dark pixels are located at the right side and the bright pixels are located at the left side, from the detected boundary, detects the extracted parts as a risk boundary (a specific boundary), and outputs position information of the risk boundary.

The determination section 324 determines whether pixels represented by the video signal Vid-d output after being delayed are dark pixels being in contact with the risk boundary extracted by the second detection section 322.

When the determination result is "Yes", the determination section 324 sets a flag Q of an output signal to "1". When the determination result is "No", the determination section 324 sets the flag Q of the output signal to "0".

In addition, "being in contact with the risk boundary" mentioned here includes the case in which a pixel is in contact with the risk boundary along one side of the pixel and the case in which the risk boundary continuous along a vertical axis is located at one corner of a pixel. Furthermore, the first detection section 321 cannot detect the boundary in the vertical or horizontal direction in an image to be displayed if video signals are not stored to a certain degree (of at least three rows). It is similar to the second detection section 322. Thus, the delay circuit 312 is provided in order to adjust the supply timing of the video signal Vid-in from the upper apparatus.

Since the timing of the video signal Vid-in supplied from the upper apparatus is different from the timing of the video signal Vid-d supplied from the delay circuit 312, horizontal scanning periods of the two signals and the like do not coincide with one another in the strict sense. However, in the following description, the timings are not specifically distinguished.

Furthermore, the storage and the like of the video signal Vid-in in the first detection section 321 and the second detection section 322 are controlled by the scanning control circuit 20.

when the flag Q supplied from the determination section 324 has a value of "1", if the grayscale level designated by the video signal Vid-d designates a level darker than "c", the replacement unit 314 replaces the video signal Vid-d with a video signal of the grayscale level "c", and outputs a video signal Vid-out.

In addition, even in the case in which the flag Q supplied from the determination section 324 has a value of "1", when the grayscale level designated by the video signal Vid-d designates a bright level equal to or more than "c", and when the flag Q has a value of "0", the replacement unit 314 outputs the video signal Vid-d as the video signal Vid-out as is without replacing the grayscale level.

The D/A converter 316 converts the video signal Vid-out, which is digital data, into an analog data signal Vx. In addition, as described above, since this embodiment employs the surface inversion, the polarity of the data signal Vx is switched whenever writing corresponding to one coma is performed in the liquid crystal panel 100.

According to the video processing circuit 30, if pixels represented by the video signal Vid-d are dark pixels being in contact with the risk boundary, the flag Q has a value of "1". If the grayscale level designated to the dark pixels is a level darker than "c", the grayscale level of the dark pixels represented by the video signal Vid-d is replaced with "c", and the video signal Vid-d is output as the video signal Vid-out.

Meanwhile, when the pixels represented by the video signal Vid-d are not the dark pixels being in contact with the risk boundary or when the pixels are in contact with the risk boundary but the grayscale level of the pixels designates a bright level equal to or more than "c", since the flag Q has a value of "0" in this embodiment, the video signal Vid-d is output as the video signal Vid-out without correcting the grayscale level.

The display operation of the liquid crystal display apparatus 1 will be described. The video signal Vid-in is supplied from the upper apparatus in the sequence of pixels of row 1 column 1 to row 1 column n, row 2 column 1 to row 2 column n, row 3 column 1 to row 3 column n, . . . , row m column 1 to row m column n over the frame. The video processing circuit 30 performs the replacement process and the like with respect to the video signal Vid-in to output the video signal Vid-out.

Herein, when viewed in a horizontal effective scanning period Ha for which the video signal Vid-out of row 1 column 1 to row 1 column n is output, the processed video signal Vid is converted into the data signal Vx of a positive polarity or a negative polarity by the D/A converter 316 as shown in FIG. 5B. Herein, the video signal Vid is converted into the data signal Vx of the positive polarity for example. The data signal Vx is sampled to the data lines 114 of columns 1 to n by the data line driving circuit 140 as the data signals X1 to Xn.

Meanwhile, in the horizontal scanning period Ha for which the video signal Vid-out of row 1 column 1 to row 1 column n is output, the scanning control circuit 20 controls the scanning line driving circuit 130 such that only the scanning signal Y1 is at a high level. If the scanning signal Y1 is at the high level, since the TFTs 116 of $1^{st}$ row are turned on, the data signal sampled to the data lines 114 is applied to the pixel electrodes 118 through the turned-on TFTs 116. Consequently, the positive voltage according to the grayscale level designated by the video signal Vid-out is written in the liquid crystal elements of row 1 column 1 to row 1 column n.

Then, the video signal Vid-in of row 2 column 1 to row 2 column n is processed by the video processing circuit 30 similarly to above to be output as the video signal Vid-out, is converted into the positive polarity data signal by the D/A converter 316, and is sampled to the data lines 114 of columns 1 to n by the data line driving circuit 140.

In the horizontal scanning period for which the video signal Vid-out of row 2 column 1 to row 2 column n is output, since only the scanning signal Y2 is at a high level by the scanning line driving circuit 130, the data signal sampled to the data lines 114 is applied to the pixel electrodes 118 through turned-on TFTs 116 of $2^{nd}$ row. Consequently, the positive voltage according to the grayscale level designated by the video signal Vid-out is written in the liquid crystal elements of row 2 column 1 to row 2 column n.

Then, the same writing operation is performed with respect to the 3rd, $4^{th}$, . . . , $m^{th}$ rows, so that a voltage according to the grayscale level designated by the video signal Vid-out is written in each liquid crystal element, resulting in the creation of a transmission image specified by the video signal Vid-in as a principle.

In the next frame, the same writing operation is performed, except that the video signal Vid-out is converted into a negative polarity data signal by polarity inversion of the data signal.

FIG. 5B is a voltage waveform diagram showing one example of the data signal Vx when the video signal Vid-out of row 1 column 1 to row 1 column n is output from the video processing circuit 30 for the horizontal scanning period (H). Since this embodiment employs the normally black mode, if the data signal Vx has a positive polarity, the data signal Vx has a high potential-side voltage (indicated by ↑ in FIG. 5B) with respect to the reference voltage Vcnt as the grayscale level processed by the video processing circuit 30 is increased (reaches a bright level). If the data signal Vx has a negative polarity, the data signal Vx has a low potential-side voltage (indicated by ↓ in FIG. 5B) by the amount corresponding to the grayscale level with respect to the reference voltage Vcnt.

In detail, if the data signal Vx has a voltage with a positive polarity, the voltage of the data signal Vx is deviated from the reference voltage Vcnt by the amount corresponding to the grayscale level in the range from a voltage Vw(+) corresponding to white to a voltage Vb(+) corresponding to black. Meanwhile, if the data signal Vx has a the voltage with a negative polarity, the voltage of the data signal Vx is deviated from the reference voltage Vcnt by the amount corresponding to the grayscale level in the range from a voltage Vw(−) corresponding to white to a voltage Vb(−) corresponding to black.

The voltage Vw(+) is symmetrical to the voltage Vw(−) about the reference voltage Vcnt, and the voltage Vb(+) is symmetrical to the voltage Vb(−) about the reference voltage Vcnt.

In addition, FIG. 5B shows the voltage waveforms of the data signal Vx, and the voltages are different from the voltage (the potential difference between the pixel electrodes 118 and the common electrode 108) applied to the liquid crystal element 120. Furthermore, the vertical scale of the voltage of the data signal in FIG. 53 is enlarged as compared with the voltage waveforms of the scanning signal and the like in FIG. 5A.

Next, a detailed example of the processes performed by the video processing circuit 30 according to this embodiment will be described.

Figure 11A:
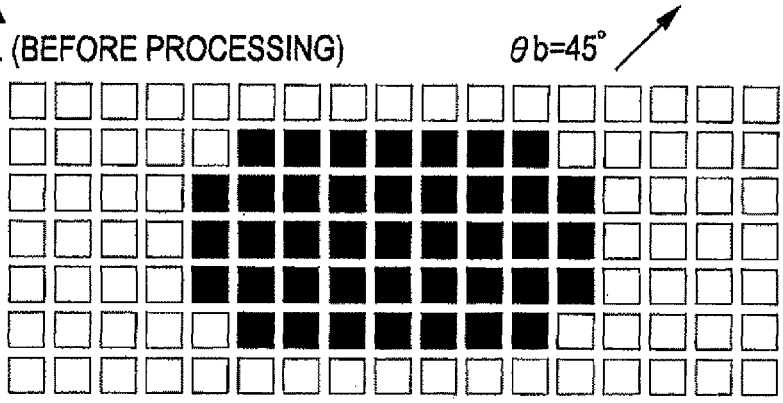
FIGS. 11A to 11D are diagrams showing a replacement process in the video processing circuit.
Figure 11B:
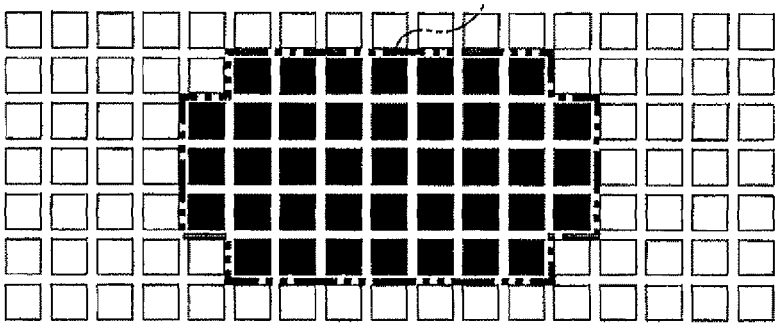

When an image (a part thereof) represented by the video signal vid-in, for example, is an image for displaying an area including black (dark) pixels, in which liquid crystal molecules are in the unstable state, on the background of white (bright) pixels in the grayscale range b as shown in FIG. 11A, the boundary detected by the first detection section 321 is shown in FIG. 11B.

Figure 11C:
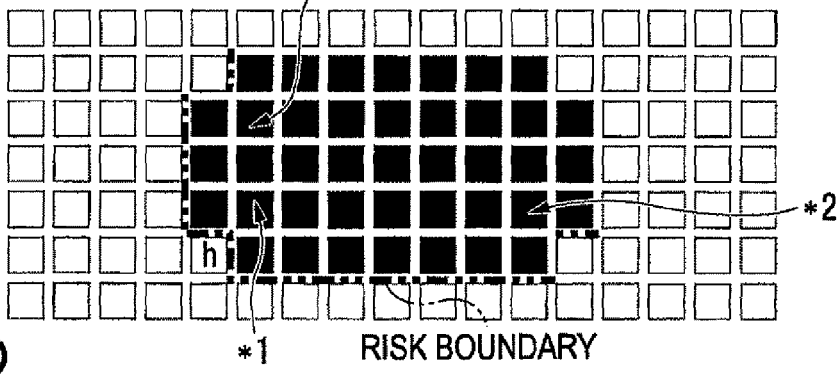

Next, as shown in FIG. 11C, the second detection section 322 extracts a part, in which the dark pixels are located at the upper side and the bright pixels are located at the lower side, and a part, in which the dark pixels are located at the right side and the bright pixels are located at the left side, from the detected boundary, and sets the detected parts as the risk boundary.

When a level darker than the grayscale level "c" is designated to dark pixels adjacent to the extracted risk boundary, the replacement unit 314 performs a replacement to the video signal with the grayscale level "c". In addition, in FIG. 11C, since the risk boundary continuous lengthwise and breadthwise is located at one corner of the left lower side of a black pixel indicated by *1, it is regarded that the black pixel is in contact with the risk boundary, so that the replacement unit 314 determines whether the level darker than the grayscale level "c" has been designated to the black pixel. This is for dealing with the case in which a pattern corresponding to a white display pixel h located at the left lower side of the black pixel moves by one pixel in the upwardly inclined direction on the right side with respect to the black pixel indicated by *1.

Differently from this, since a risk boundary fractured only in the vertical or horizontal direction is located at one corner of a black pixel indicated by *2 and the risk boundary continuous lengthwise and breadthwise is not located at one corner thereof, the replacement unit 314 does not determine whether the level darker than the grayscale level "c" has been designated to the black pixel.

Figure 11D:
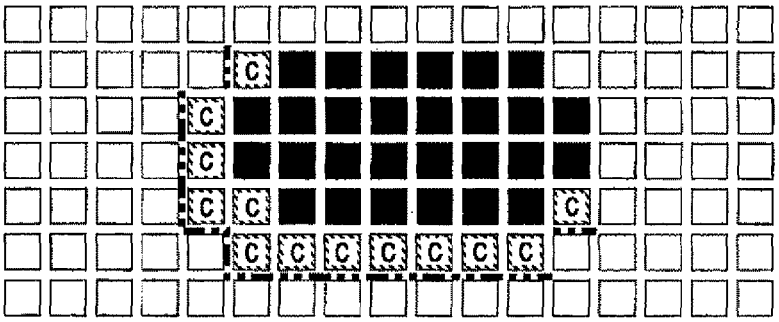

Since all the black pixels mentioned here are pixels with levels darker than the grayscale level "c", the image shown in FIG. 11A is shown in FIG. 11D after the grayscale level of the black pixels being in contact with the risk boundary is replaced with the grayscale level "c" by the replacement unit 314.

Figure 12A:
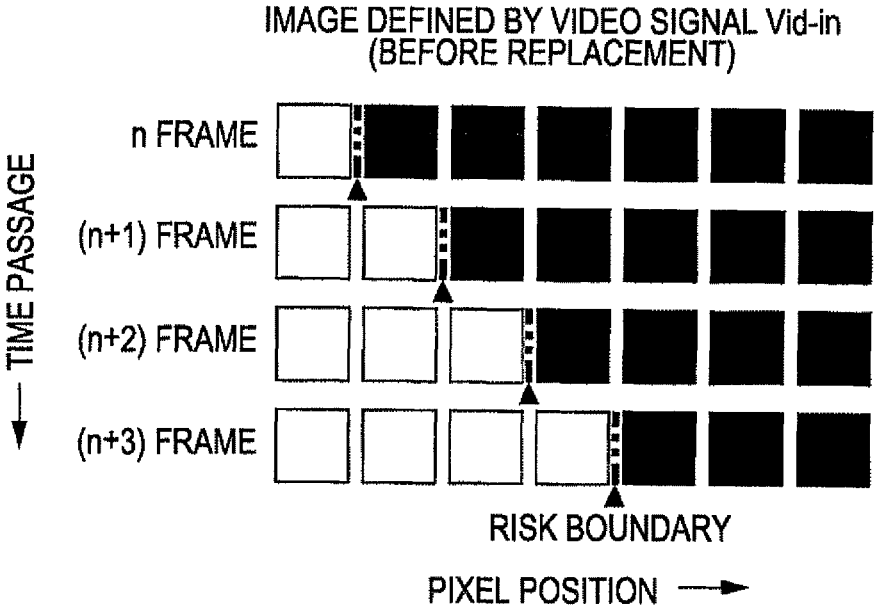
FIGS. 12A and 12B are diagrams showing the control of reverse tilt performed by the video processing circuit.
Figure 12B:
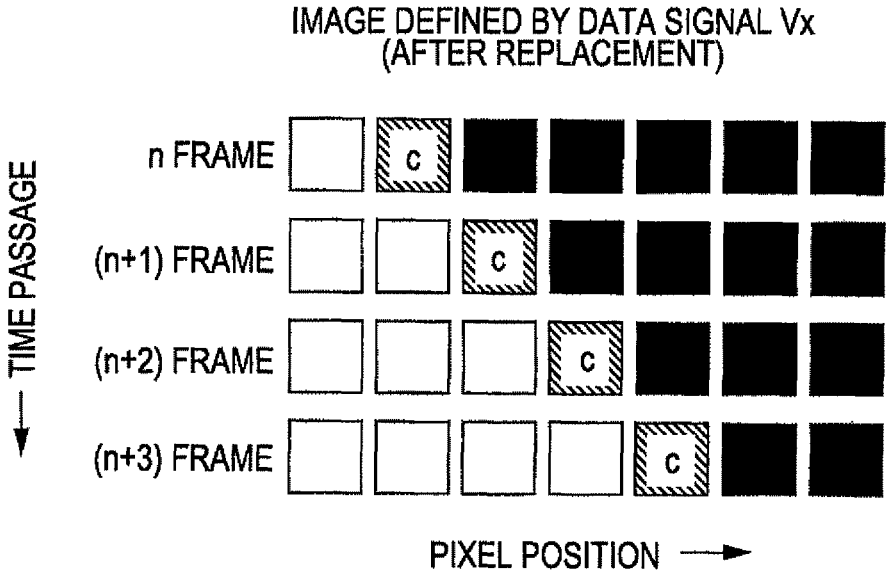

Thus, in relation to the image represented by the video signal Vid-in, even if an area including the black pixels moves by one pixel in any one of the right upper direction, the right direction and the upper direction and the black pixels are changed to white pixels as shown in FIG. 12A, the black pixels are not directly changed to the white pixels from the state in which liquid crystal molecules are unstable in the liquid crystal panel 100. That is, as shown in FIG. 12B, after the state where the liquid crystal molecules are stable is forcedly formed by the application of the voltage Vc corresponding to the grayscale level "c", the black pixels are changed to the white pixels.

Consequently, in this embodiment, since only a process for detecting the boundary and the risk boundary among pixels, instead of the entire image corresponding to one frame, is performed, an increase in the scale and complexity of the video processing circuit can be prevented, as compared with the configuration in which an image corresponding to two frames or more is analyzed and the movement of the image is detected. In addition, an area where the reverse tilt domain may easily occur can be prevented from being continuous according to the movement of black pixels.

Moreover, in this embodiment, in an image specified by the video signal Vid-in, pixels having a grayscale level to be replaced are dark pixels being in contact with bright pixels, and are pixels located at the downstream side of the tilt azimuth with respect to the bright pixels among dark pixels to which a grayscale level darker than the grayscale level "c" is designated. Thus, a part, in which display not based on the video signal Vid-in is performed, corresponds to dark pixels being in contact with the bright pixels without considering the tilt azimuth angle, and can be suppressed to be small as compared with the configuration in which all the dark pixels to which the grayscale level darker than the grayscale level "c" is designated are indiscriminately replaced.

In addition, in this embodiment, since a video signal of a set value or more is not indiscriminately clipped, an adverse influence resulted from an unused voltage range is prevented from being exerted on a contrast ratio.

Furthermore, since it is not necessary to change the structure of the liquid crystal panel 100 and the like, reduction of an aperture ratio is not caused. In addition, this embodiment can be applied to the previously manufactured liquid crystal panel without any consideration of a structure.

Other Examples of Azimuth Angle

In the previous embodiment, the case in which the tilt azimuth angle θb is 45° in the VA mode has been described as an example. Next, an example in which the tilt azimuth angle θb is not 45° will be described.

Figure 13A:
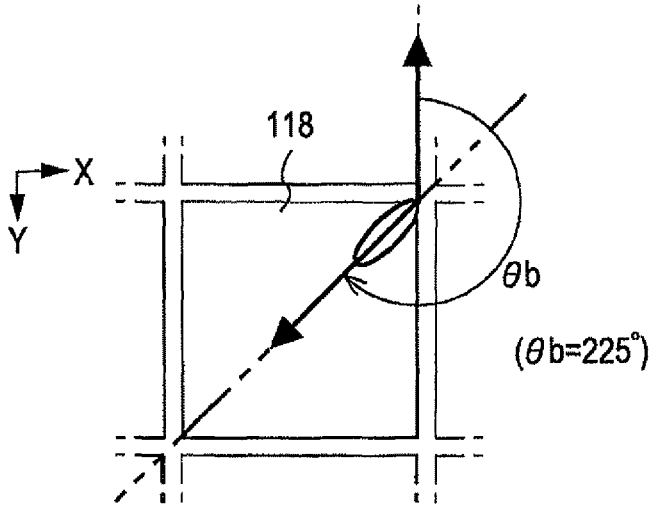
FIGS. 13A and 13B are diagrams showing the case in which another tilt azimuth is employed in the liquid crystal panel.
Figure 13B:
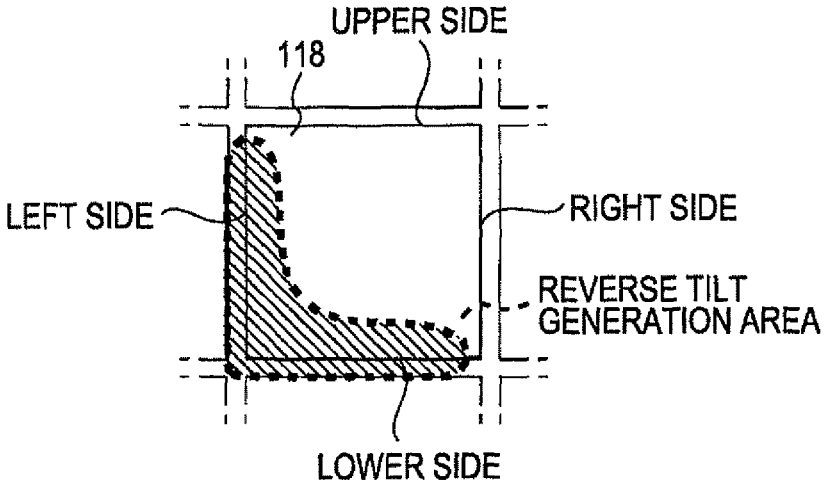
Figure 14A:
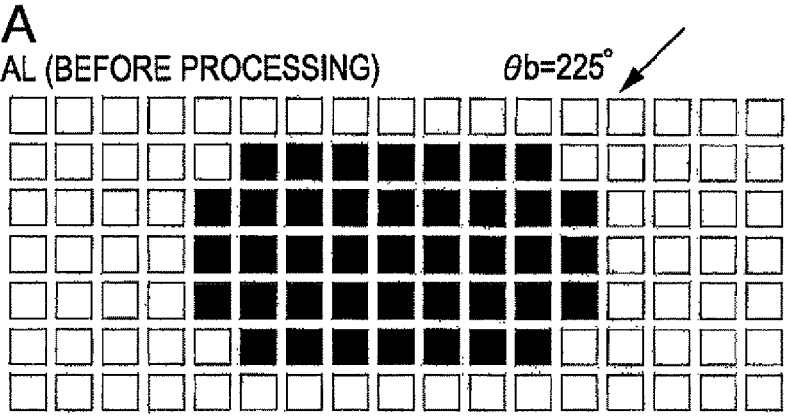
FIGS. 14A to 14D are diagrams showing a replacement process when another tilt azimuth is employed.
Figure 14B:
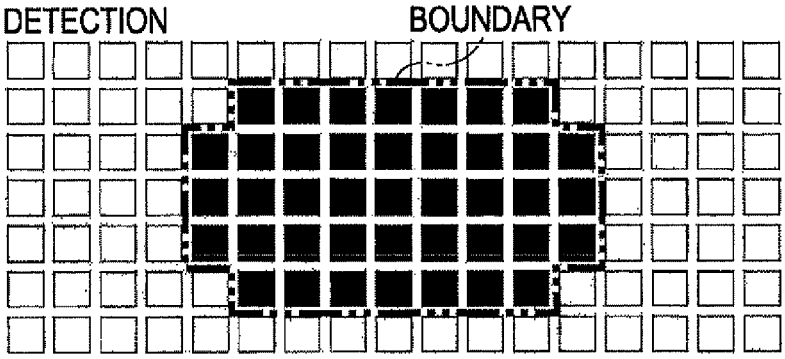
Figure 14C:
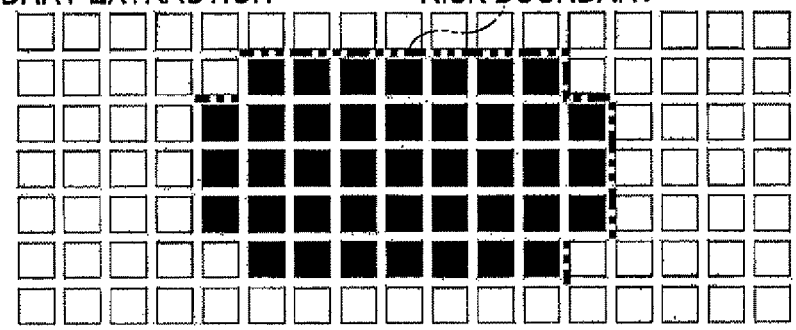
Figure 14D:
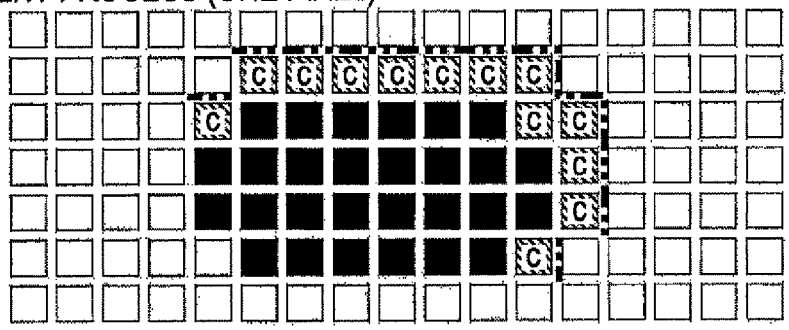

First, an example in which the tilt azimuth angle θb is 225° as shown in FIG. 13A will be described. In this example, among a subject pixel and peripheral pixels, when only the subject pixel is changed to bright pixels from the state in which liquid crystal molecules are unstable, the reverse tilt occurs in an inner area along the left side and the lower side of the subject pixel as shown in FIG. 13B. In addition, this example is equivalent to an example obtained by rotating the tilt azimuth angle θb of 45° as shown in FIGS. 8A to 8C by 180°.

When the tilt azimuth angle θb is 225°, the condition (2) of the conditions (1) to (3), in which the reverse tilt domain occurs when the tilt azimuth angle θb is 45°, is corrected as follows; (2) in the n frame, the bright pixel (the applied voltage is high) is located at the right upper side, the right side or the upper side of the adjacent dark pixel (the applied voltage is low), which corresponds to the upstream side of the tilt azimuth in the liquid crystal molecules. In addition, the conditions (1) and (3) are not changed.

Consequently, if the tilt azimuth angle θb is 225°, the dark pixel is adjacent to the bright pixel in the n frame. When the dark pixel is located at the left lower side, the left side and the lower side of the bright pixel, it is preferred to take measures for preventing the liquid crystal molecules from being in the unstable state with respect to the liquid crystal element corresponding to the dark pixel.

To this end, it is preferred to employ the configuration in which the second detection section 322 of the video processing circuit 30 extracts a part, in which dark pixels are located at the lower side and bright pixels are located at the upper side, and a part, in which the dark pixels are located at the left side and the bright pixels are located at the right side, from the boundary detected by the first detection section 321, and detects the extracted parts as the risk boundary.

With such a configuration, when the tilt azimuth angle θb is 225°, as shown in FIGS. 14A to 14D, in relation to an image specified by the video signal Vid-in, even if an area including black pixels moves by one pixel in any one of the left lower direction, the left direction and the lower direction and the black pixels are changed to white pixels, the black pixels are not directly changed to the white pixels from the state in which liquid crystal molecules are unstable in the liquid crystal panel 100. That is, after the state where the liquid crystal molecules are stable is forcedly formed by the application of the voltage Vc corresponding to the grayscale level "c", since the black pixels are changed to the white pixels, the occurrence of the reverse tilt domain can be prevented.

Figure 15A:
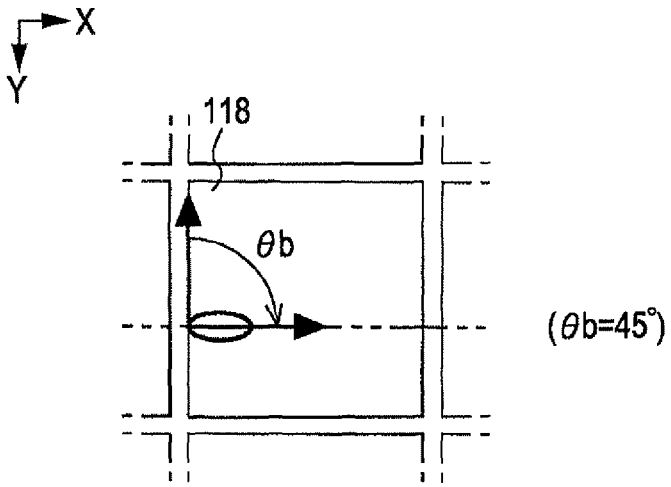
FIGS. 15A and 15B are diagrams showing the case in which another tilt azimuth is employed in the liquid crystal panel.
Figure 15B:
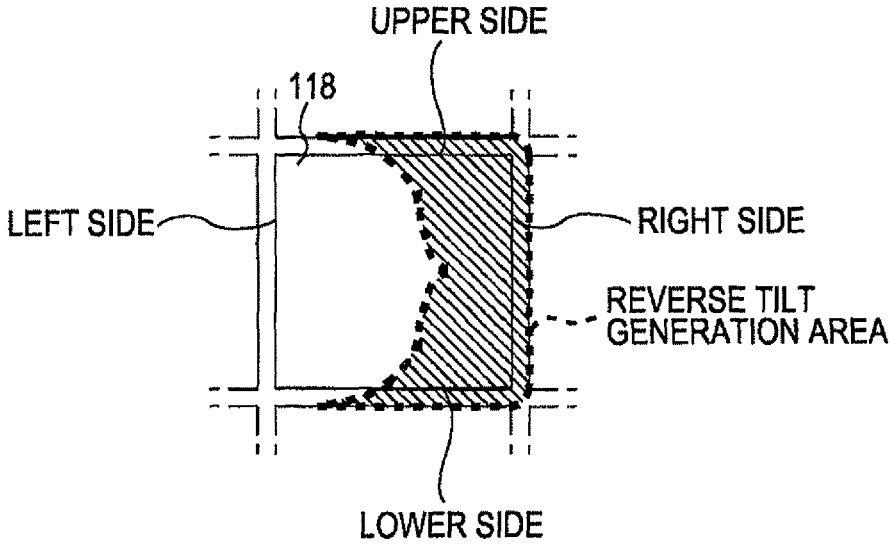
Figure 16A:
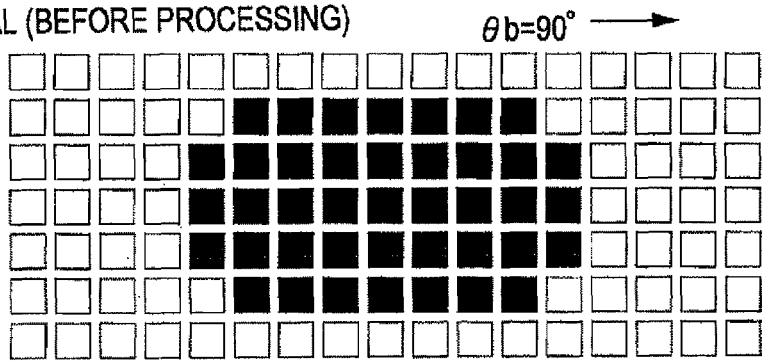
FIGS. 16A to 16D are diagrams showing a replacement process when another tilt azimuth is employed.
Figure 16B:
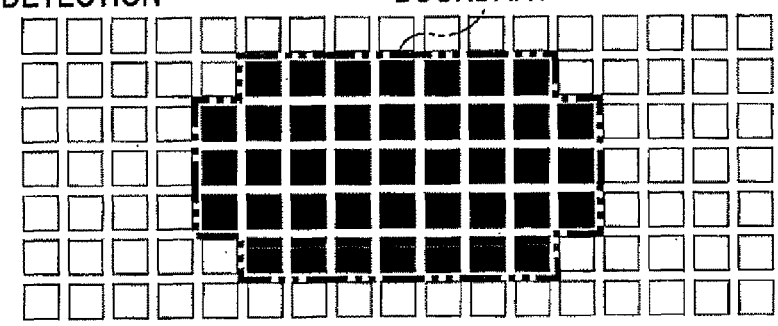
Figure 16C:
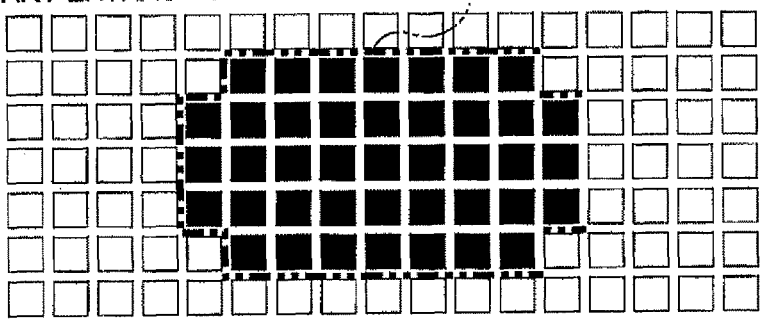
Figure 16D:
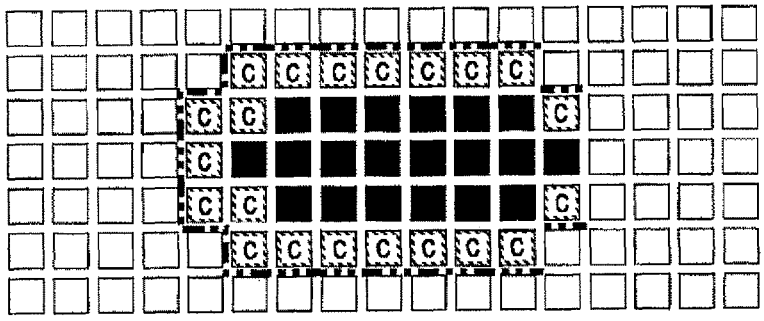

Next, an example in which the tilt azimuth angle θb is 90° as shown in FIG. 15A will be described. In this example, among a subject pixel and peripheral pixels, when only the subject pixel is changed to bright pixels from the state in which liquid crystal molecules are unstable, the reverse tilt mainly occurs in an area along the right side of the subject pixel as shown in FIG. 15B. In this regard, it can be said that the reverse tilt domain in the subject pixel also occurs in the right-biased portion of the upper side and the right-biased portion of the lower side by the amount of the width in which the reverse tilt domain has occurred in the right side.

When the tilt azimuth angle θb is 90°, the condition (2) of the conditions (1) to (3), in which the reverse tilt domain occurs when the tilt azimuth angle θb is 45°, is corrected as follows: (2) in the n frame, the bright pixel (the applied voltage is high) is not only located at the left side of the adjacent dark pixel (the applied voltage is low), which corresponds to the upstream side of the tilt azimuth in the liquid crystal molecules, but also at the upper or lower side affected by the influence of an area generated at the left side thereof. In addition, the conditions (1) and (3) are not changed. Consequently, if the tilt azimuth angle θb is 90°, the dark pixel is adjacent to the bright pixel in the n frame. When the dark pixel is located at the right side, the lower side and the upper side of the bright pixel, it is preferred to take measures for preventing the liquid crystal molecules from being in the unstable state with respect to the liquid crystal element corresponding to the dark pixel.

To this end, it is preferred to employ the configuration in which the second detection section 322 of the video processing circuit 30 extracts a part, in which dark pixels are located at the right side and bright pixels are located at the left side, a part, in which the dark pixels are located at the upper side and the bright pixels are located at the lower side, and a part, in which the dark pixels are located at the lower side and the bright pixels are located at the upper side, from the boundary detected by the first detection section 321, and detects the extracted parts as the risk boundary.

With such a configuration, when the tilt azimuth angle θb is 90°, as shown in FIGS. 16A to 16D, in relation to an image specified by the video signal Vid-in, even if an area including black pixels moves by one pixel in any one of the upper direction, the right upper direction, the right direction, the right lower and the lower direction and the black pixels are changed to white pixels, the black pixels are not directly changed to the white pixels from the state in which liquid crystal molecules are unstable in the liquid crystal panel 100. That is, after the state where the liquid crystal molecules are stable is forcedly formed by the application of the voltage Vc corresponding to the grayscale level "c", since the black pixels are changed to the white pixels, the occurrence of the reverse tilt domain can be prevented.

TN Mode

In the previous embodiment, the example in which the liquid crystal 105 of the VA mode is used has been described. Next, an example in which the liquid crystal 105 of a TN mode is used will be described.

Figure 17A:
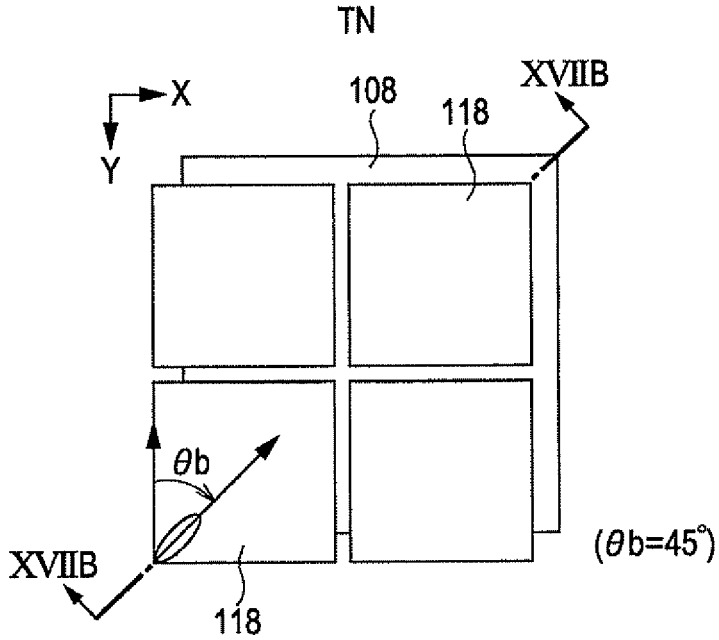
FIGS. 17A and 17B are diagrams explaining initial alignment when a TN mode is used in the liquid crystal panel.
Figure 17B:
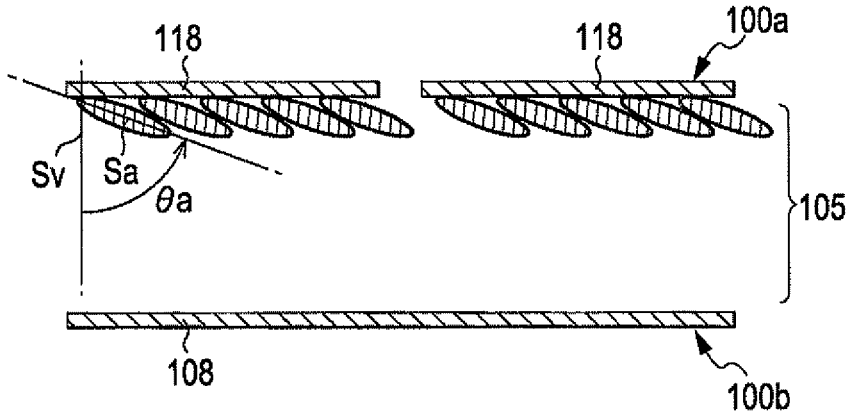

FIG. 17A is a diagram showing pixels of (2×2) in the liquid crystal panel 100, and FIG. 17B is a simple sectional view taken along a vertical surface including line XVIIB-XVIIB in FIG. 17A.

As shown in FIGS. 17A and 17B, when the potential difference between the pixel electrodes 118 and the common electrode 108 is zero, the liquid crystal molecules of the TN mode are initially aligned at a tilt angle of θa and a tilt azimuth angle of θb (=45°). In contrast to the VA mode, since the liquid crystal molecules are inclined in the horizontal direction with respect to the substrate in the TN mode, the tilt angle of θa in the TN mode is larger than that in the VA mode.

In the example in which the liquid crystal 105 of the TN mode is used, a normally white mode, in which the liquid crystal elements 120 are in a white state when no voltage is applied, is frequently used because a high contrast ratio is achieved and the like.

Figure 4B:
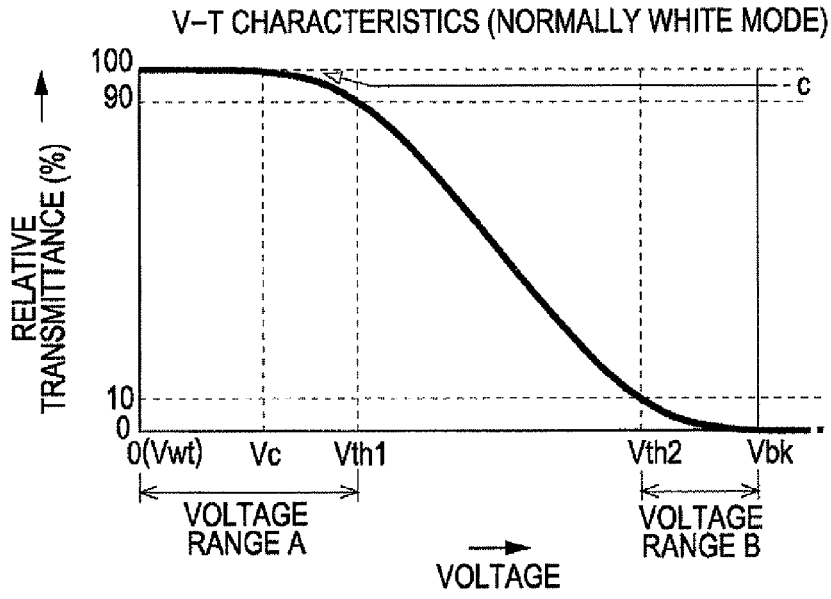

Thus, when the liquid crystal 105 of the TN mode is used and the normally white mode is employed, the relationship between the applied voltage and the transmittance of the liquid crystal element 120 is indicated by the V-T characteristics as shown in FIG. 4B, and the transmittance is reduced as the applied voltage is increased. However, when the applied voltage of the liquid crystal element 120 is less than the voltage Vc, the fact that the liquid crystal molecules are in the unstable state is maintained similarly to the normally black mode.

In the normally white mode of the TN mode as described above, as shown in FIG. 18A, it is assumed that only one pixel located at the right upper side of the four white pixels of (2×2) in the (n−1) frame is changed to a black pixel in the n frame from the state in which the liquid crystal molecules are unstable. As described above, in the normally white mode, the potential difference between the pixel electrodes 118 and the common electrode 108 is large at the black pixels as compared with the white pixels in contrast to the normally black mode. Thus, at the right upper pixel changed from the white to the black, as shown in FIG. 18B, the liquid crystal molecule is changed from the state indicated by a solid line to the state indicated by a broken line, that is, the liquid crystal molecule stands up in the direction (the vertical direction of the substrate surface) along the electric field direction.

However, the potential difference generated in the gap between the pixel electrodes 118 (Wt) of white pixels and the pixel electrodes 118 (Bk) of black pixels is approximately the same as the potential difference generated between the pixel electrodes 118 (Bk) of black pixels and the common electrode 108, and the gap between the pixel electrodes is narrower than the gap between the pixel electrodes 118 and the common electrode 108. Thus, in terms of electric field strength, the transverse electric field generated in the gap between the pixel electrodes 118 (Wt) and the pixel electrodes 118 (Bk) is stronger than the longitudinal electric field generated in the gap between the pixel electrodes 118 (Bk) and the common electrode 108.

Since the right upper pixel is a white pixel in which the liquid crystal molecule is in an unstable state in (n−1) frame, a time is required until the liquid crystal molecule is inclined according to the strength of the longitudinal electric field. Meanwhile, the transverse electric field from the adjacent pixel electrodes 118 (Wt) is stronger than the longitudinal electric field generated by applying the black level voltage to the pixel electrodes 118 (Bk). Consequently, at the pixel to be changed to the black, as shown in FIG. 18B, a liquid crystal molecule Rv adjacent to the white pixel is in a reverse tilt state ahead of other liquid crystal molecules to be inclined according to the longitudinal electric field.

The liquid crystal molecule Rv in the reverse tilt state has an adverse influence on the movement of other liquid crystal molecules to stand up in the horizontal direction with respect to the substrate according to the longitudinal electric field as indicated by the broken line. In this regard, as shown in FIG. 18C, an area where the reverse tilt occurs in the pixel to be changed to the black is expanded to a wide range while encroaching the pixel to be changed to the black beyond the gap between the pixel to be changed to the black and the white pixels.

Figure 18A:
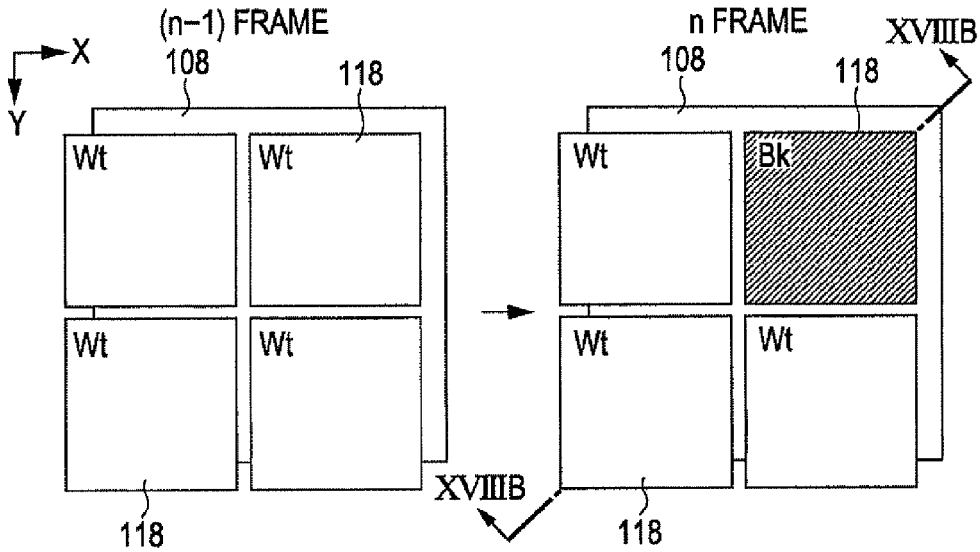
FIGS. 18A to 18C are diagrams explaining reverse tilt occurring in the liquid crystal panel.
Figure 18B:
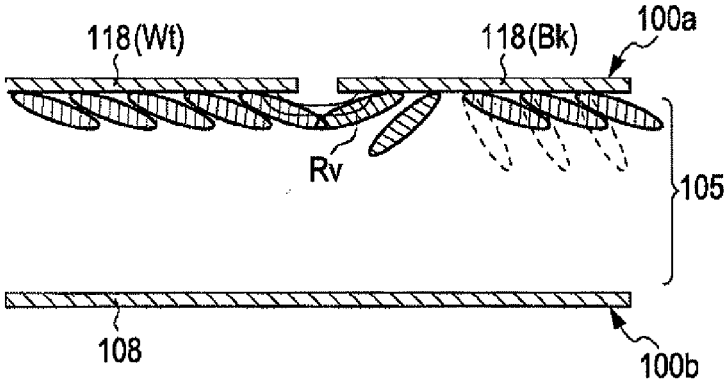
Figure 18C:
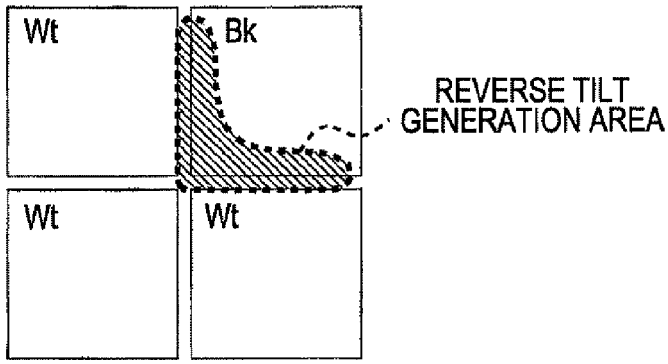

Thus, based on the contents of FIGS. 18A to 18C, in the case in which white pixels are located around a target pixel to be changed to the black, when the white pixels are adjacent to the left lower side, the left side and the lower side of the target pixel, it can be said that the reverse tilt occurs in the inner area of the target pixel along the left side and the lower side of the target pixel.

Figure 19A:
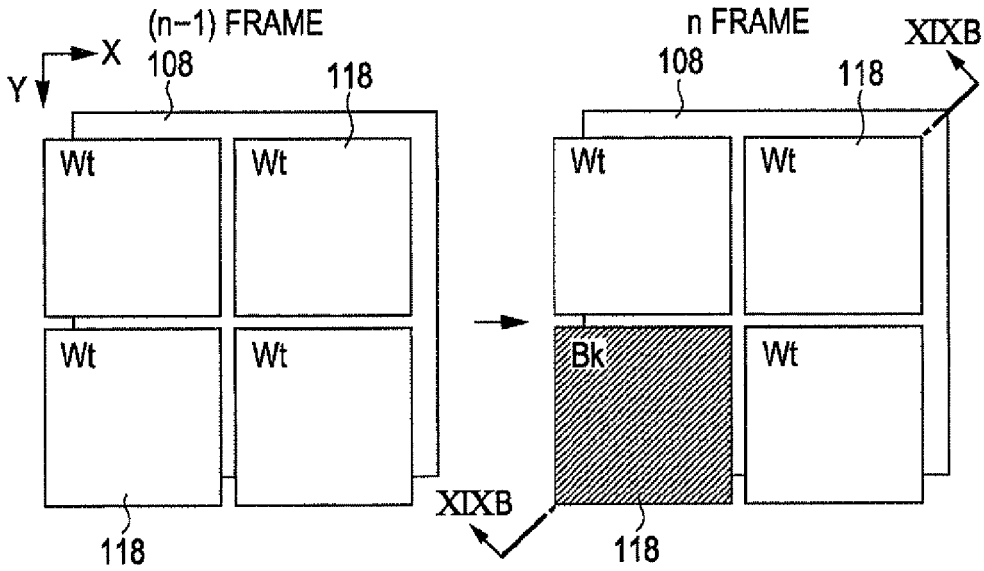
FIGS. 19A to 19C are diagrams explaining reverse tilt occurring in the liquid crystal panel.
Figure 19B:
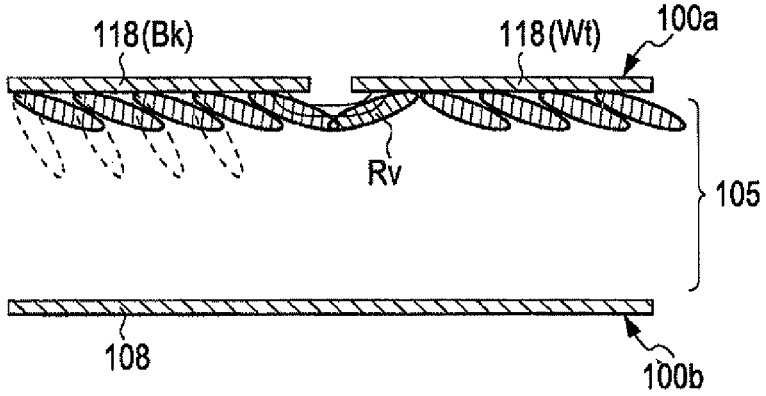
Figure 19C:
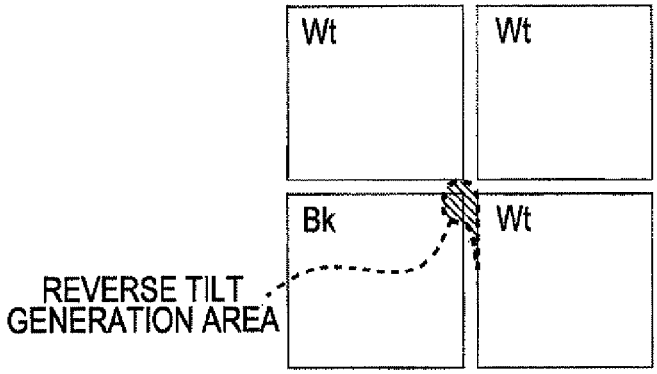

Meanwhile, as shown in FIG. 19A, it is assumed that only one pixel located at the left lower side of the four white pixels of (2×2) in the (n−1) frame is changed to a black pixel in the n frame from the state in which the liquid crystal molecules are unstable. Even in such a change, the transverse electric field, which is stronger than the longitudinal electric field generated in the gap between the pixel electrodes 118 (Bk) and the common electrode 108, is generated in the gap between the pixel electrodes 118 (Bk) of black pixels and the pixel electrodes 118 (Wt) of white pixels. Due to the transverse electric field, as shown in FIG. 19B, the alignment state of a liquid crystal molecule Rv of the white pixel-side, which is adjacent to the black pixel, is changed ahead of other liquid crystal molecules to be inclined according to the longitudinal electric field, and enters a reverse tilt state. However, since the strength of the longitudinal electric field does not change from (n−1) frame at the white pixels, the liquid crystal molecule Rv rarely has an influence on other liquid crystal molecules. Thus, an area where the reverse tilt occurs at a pixel which is not changed from the white pixel is small enough to be ignored as shown in FIG. 19C as compared with the example of FIG. 18C.

Meanwhile, among the four pixels of (2×2), at the left lower pixel to be changed from the white to the black, since the initial alignment direction of the liquid crystal molecules is rarely affected by the transverse electric field, even if the longitudinal electric field is applied to the liquid crystal molecules, liquid crystal molecules entering the reverse tilt state rarely exist. Thus, the left lower pixel is changed to the black pixel as a target because the liquid crystal molecules accurately stand up as indicated by the broken line of FIG. 18B in the vertical direction with respect to the substrate surface with the increase in the strength of the longitudinal electric field, so that the deterioration of display quality does not occur.

Therefore, in the case of the normally white mode in which the tilt azimuth angle θb is 45° in the TN mode, the condition (1) is maintained as is.

(2) in the n frame, the dark pixel (the applied voltage is high) is located at the right upper side, the right side or the upper side with respect to the adjacent bright pixel (the applied voltage is low).

(3) when the liquid crystal molecules of the pixel to be changed to the dark pixel in the n frame have been in an unstable state in the frame (the (n−1) frame) prior to one frame, the reverse tilt occurs in the dark pixel in the n frame.

Thus, when considering the generation state by employing the (n+1) frame as a reference, even if dark pixels in the (n+1) frame satisfy the above positional relationship due to the movement of the image, it is preferred to take measures for preventing the liquid crystal molecules of the pixels from being in the unstable state in the n frame before the change.

In contrast to the normally black mode, in the normally white mode, when considering the point that the applied voltage of the liquid crystal element is reduced as the gray-scale level is high (bright), it is preferred to change the configuration of the video processing circuit 30 as follows.

That is, in the n frame, it is preferred to employ the configuration in which the second detection section 322 of the video processing circuit 30 extracts a part, in which dark pixels are located at the lower side and bright pixels are located at the upper side, and a part, in which the dark pixels are located at the left side and the bright pixels are located at the right side, from the boundary detected by the first detection section 321, and detects the extracted parts as the risk boundary. Furthermore, when the flag Q supplied from the determination section 324 has a value of "1", if the grayscale level designated by the video signal Vid-d designates a level darker than "c", the replacement unit 314 replaces the video signal Vid-d with a video signal of the grayscale level "c", and outputs a video signal Vid-out.

So far, in this example, the case in which the tilt azimuth angle θb is 45° in the TN mode has been described. However, when considering that the generation direction of the reverse tilt domain is opposite to that in the VA mode, it is possible to easily analogize measures for the cases where the tilt azimuth angle θb is not 45° and configurations for the cases from the above descriptions.

Pattern Movement Direction

In the previous embodiment, the part in which the dark pixels are adjacent to the bright pixels in the vertical or horizontal direction is detected as the boundary. The reason for this is to deal with all movement directions of the image pattern.

Meanwhile, when considering movement of a cursor on a display screen such as a word processor or a text editor, a case may occur in which it is sufficient even if only a horizontal (X) direction is assumed as the movement direction of an image pattern.

Furthermore, since the video signal Vid-in is supplied in the sequence of pixels of row 1 column 1 to row 1 column n, row 2 column 1 to row 2 column n, row 3 column 1 to row 3 column n, . . . , row m column 1 to row m column n, if only the horizontal direction is assumed as the movement direction, it is enough that grayscale levels of two pixels (i.e., two pixels continuously supplied) adjacent in the X direction are compared.

Figure 20:
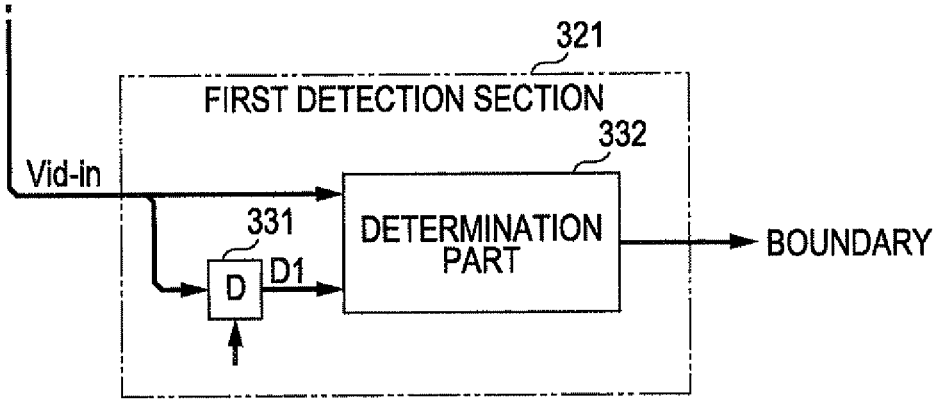
FIG. 20 is a diagram showing the configuration of a main element according to a modified example of the video processing circuit.

In detail, as shown in FIG. 20, the first detection section 321 may include a delay circuit 331, which delays the video signal Vid-in supplied from the upper apparatus by one pixel and outputs a video signal D1, and a determination part 332 that receives the video signal Vid-in and the video signal D1. Between them, since the determination part 332 simply has a configuration of detecting the following two cases as a boundary, it is not necessary to store the video signal Vid-in of three rows or more. The first case is that the grayscale level of the video signal Vid-in is in the grayscale range a and the grayscale level of the video signal D1 is in the grayscale range b, and the second case is that the grayscale level of the video signal Vid-in is in the grayscale range b and the grayscale level of the video signal D1 is in the grayscale range a.

In addition, similarly to the previous embodiment, the detected boundary at which the dark pixels have a predetermined positional relationship to the bright pixels is detected as the risk boundary by the second detection section 322.

In the case in which only the horizontal direction is assumed as the movement direction of the image pattern, for example, when the tilt azimuth angle θb is 45° in the VA mode, it is preferred that the first detection section 321 detects only a part, in which pixels in the grayscale range a are adjacent to pixels in the grayscale range b in the vertical direction, as the boundary. In such a case, the first detection section 321 does not treat a part, in which the pixels are adjacent to each other in the horizontal direction, as the boundary.

Figure 21A:
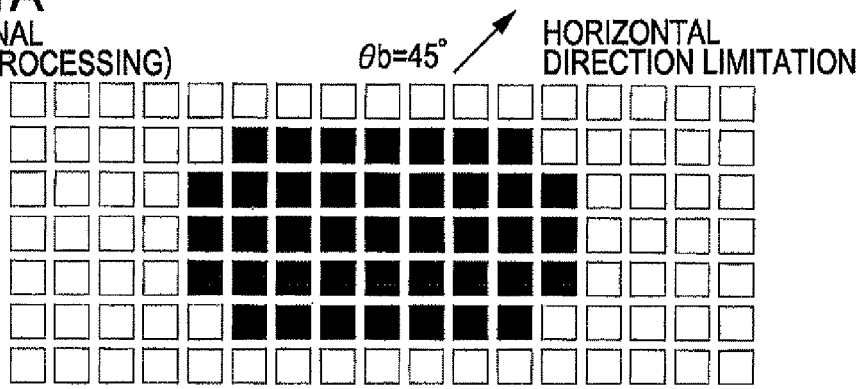
FIGS. 21A to 21D are diagrams showing a replacement process according to a modified example of the video processing circuit.
Figure 21B:
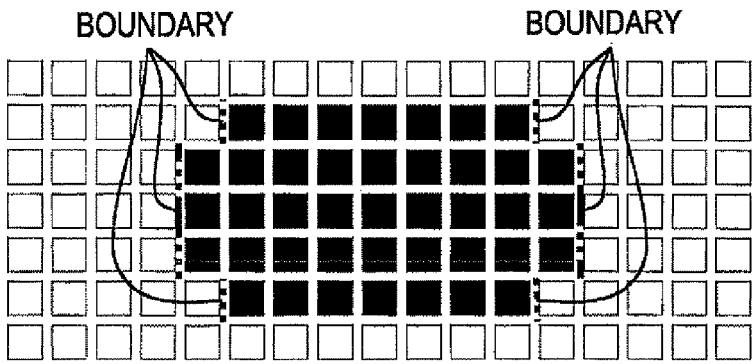

In such a configuration, for example, when an image represented by the video signal Vid-in is shown in FIG. 21A, the boundary detected by the first detection section 321 includes only a part in which black pixels in the grayscale range a are adjacent to white pixels in the grayscale range b in the vertical direction as shown in FIG. 21B.

Figure 21C:
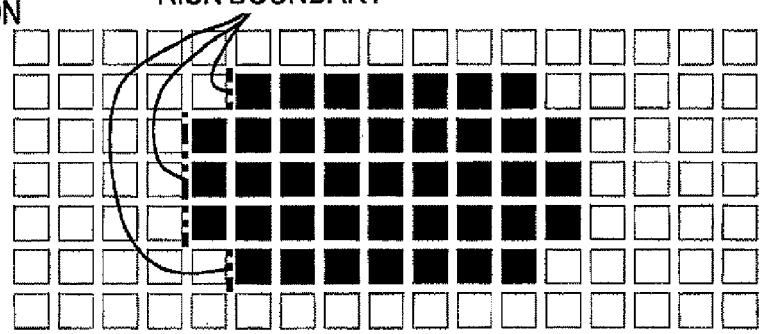

Thus, the risk boundary extracted by the second detection section 322 includes only a part in which white pixels are located at the left side and black pixels are located at the right side as shown in FIG. 21C.

Figure 21D:
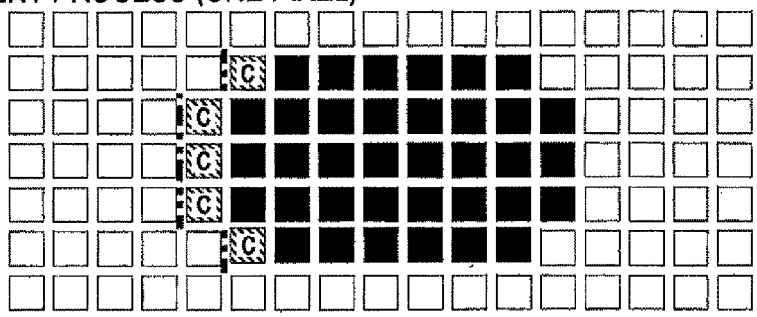
Figure 22A:
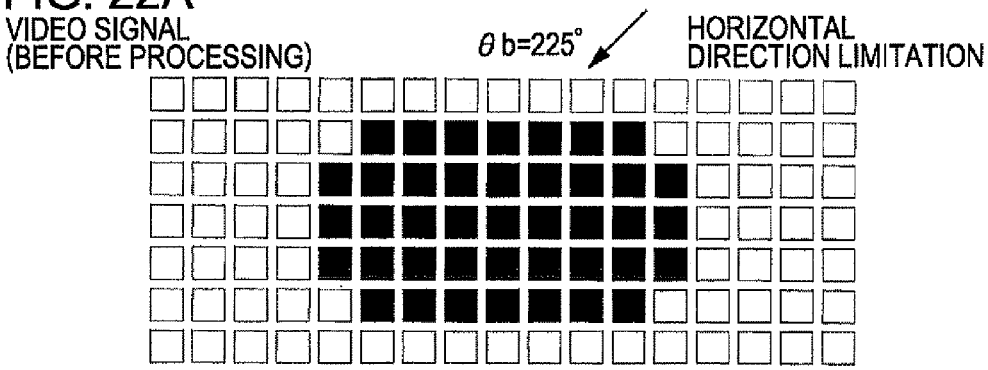
FIGS. 22A to 22D are diagrams showing a replacement process according to a modified example of the video processing circuit.
Figure 22B:
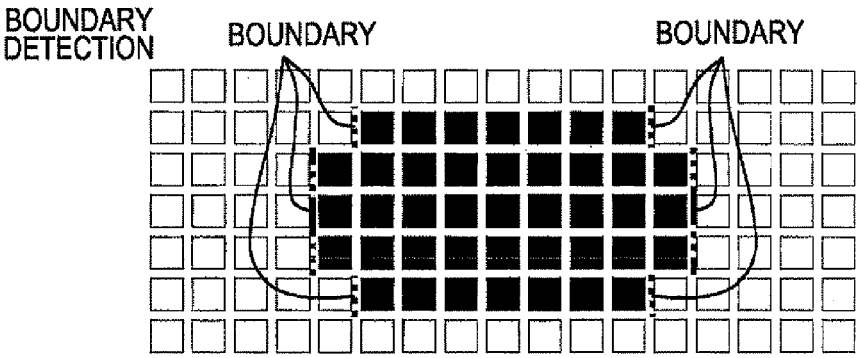
Figure 22C:
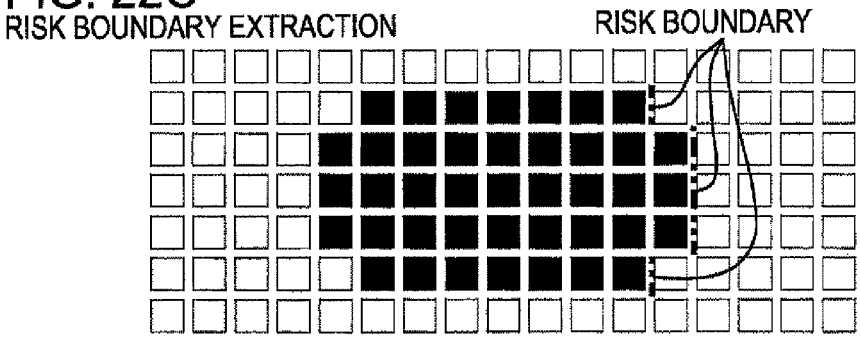
Figure 22D:
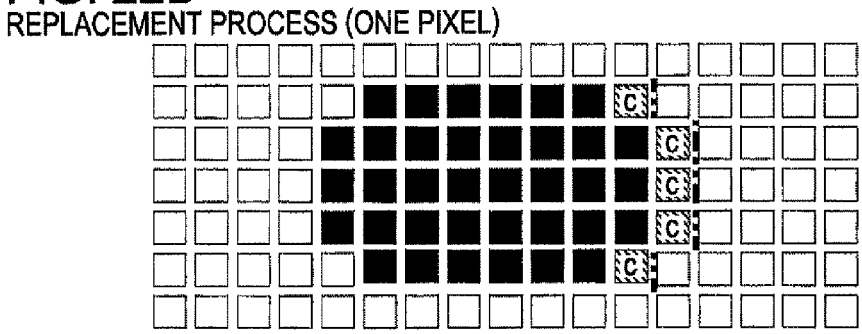

Since all the black pixels mentioned here are pixels with levels darker than the grayscale level "c", all the grayscale levels of black pixels being in contact with the risk boundary are replaced with the grayscale level "c" by the replacement unit 314 as shown in FIG. 21D.

If only the horizontal direction is assumed as the movement direction of the image pattern, since the first detection section 321 simply has a configuration in which grayscale data corresponding to two pixels which are continuously supplied is compared to each other, the configuration can be simplified as compared with a configuration in which the vertical direction and the inclination direction are also assumed as the movement direction of the image pattern.

So far, the example in which the VA mode is employed and the tilt azimuth angle θb is 45° has been described. The case in which the VA mode is employed and the tilt azimuth angle θb is 225° is as shown in FIGS. 22A to 22D.

The Number of Pixels to be Replaced

In the embodiment, when the applied voltage of a pixel being in contact with the risk boundary is less than Vc, the grayscale level of the pixel is replaced with "c", so that the voltage Vc is applied to a liquid crystal element, and thus liquid crystal molecules are prevented from being in the unstable state. That is, a pixel receiving an applied voltage to be replaced is limited to the pixel being in contact with the risk boundary. However, a case may occur in which the pixel to be replaced includes one or more pixels located in the direction opposite to that of the risk boundary with respect to the pixel being in contact with the risk boundary, as well as the pixel being in contact with the risk boundary. Next, such a case will be described.

When the liquid crystal molecules are changed from the unstable state to other states as described above, a response time is required. Therefore, after the voltage Vc is applied, even if 16.7 milliseconds corresponding to one frame have lapsed, the liquid crystal molecules may not escape from the unstable state.

In the previous embodiment, even if the image pattern displayed in a certain frame moves by one pixel in the next frame and satisfies the conditions (1) and (2) in the next frame, if the grayscale level for allowing the applied voltage to be less than Vc is designated to the pixel being in contact with the risk boundary such that the condition (3) is not satisfied, the grayscale level is replaced with the grayscale level "c". However, in such a case, when the pixel having received the voltage Vc satisfies the conditions (1) and (2) in the next frame, since the liquid crystal molecules do not enter a stable state in the next frame, the reverse tilt domain may occur.

The time interval in which the display screen of the liquid crystal panel 100 is updated is set to S (milliseconds) and a response time until the liquid crystal element 120 is in an alignment state according to the voltage Vc applied thereto from the state in which the applied voltage is less than Vc is set to T (milliseconds).

In the embodiment, since the liquid crystal panel 100 and the video signal Vid-in are driven at a constant speed as described above, the time interval S is 16.7 milliseconds which is equal to the frame. If S (=16.7) is equal to or more than T, it is enough that a candidate to be replaced includes only one pixel being in contact with the risk boundary as described in the previous embodiment.

However, if S<T≤2S, even if 16.7 milliseconds corresponding to one frame have lapsed after the voltage Vc is applied, the liquid crystal molecules may not escape from the unstable state. A pixel receiving the applied voltage to be replaced includes the total two pixels, that is, a pixel being in contact with the risk boundary, and a pixel adjacent to the pixel, which is in contact with the risk boundary, in the direction opposite to that of the risk boundary.

To this end, for example, when the tilt azimuth angle θb is 45° in the VA mode, it is preferred that the determination section 324 performs a determination operation as follows. That is, when the pixel represented by the video signal Vid-d output after being delayed is a pixel being in contact with the risk boundary, which is extracted by the second detection section 322, or when the pixel represented by the video signal Vid-d is a pixel, which is located in the direction opposite to that of the risk boundary with respect to the pixel being contact with the risk boundary, if the pixel is a dark pixel, the determination section 324 set the flag Q to "1". Otherwise, it is preferred that the determination section 324 sets the flag Q to "0".

Figure 23A:
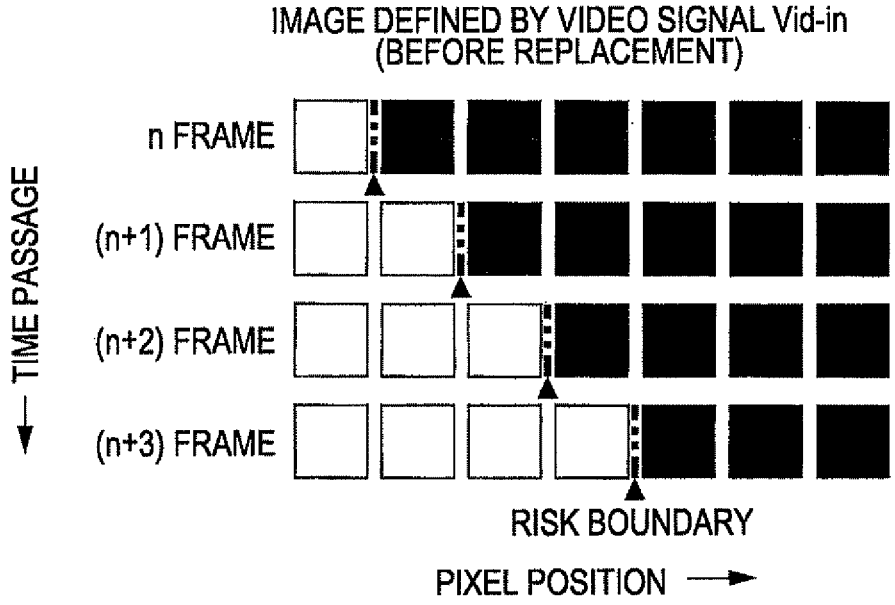
FIGS. 23A and 23B are diagram showing the control of reverse tilt when the horizontal direction is employed as the movement direction.
Figure 23B:
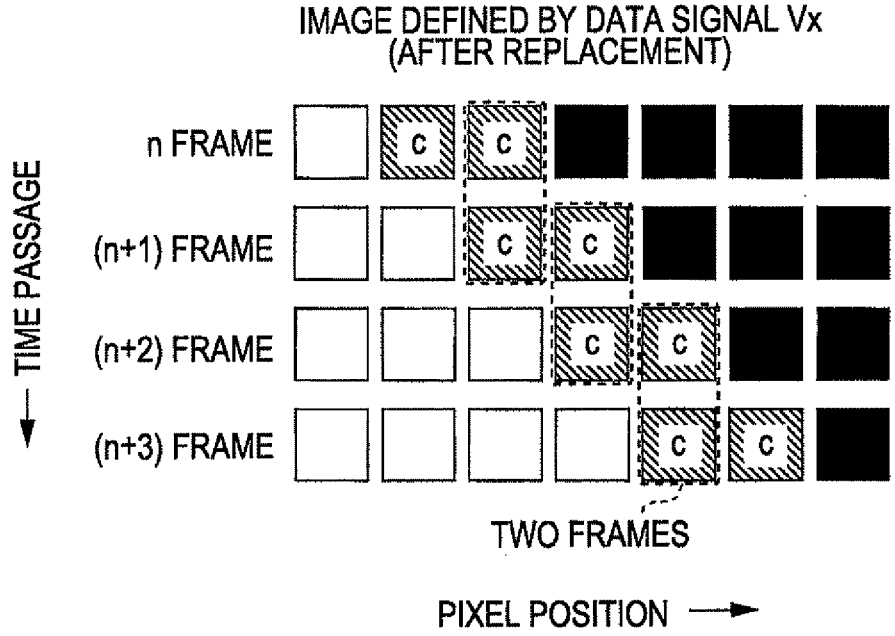

If the two pixels are to be replaced as described above, for example, when the image pattern moves in the right direction by one pixel for each frame as shown in FIG. 23A, two black pixels located at the end of the risk boundary, that is, black pixels, to which the grayscale level for allowing the applied voltage to be less than Vc is designated, are doubled because the period for which the voltage Vc is applied to the liquid crystal element becomes 2 frames through the replacement as shown in FIG. 23B. Consequently, the liquid crystal molecules sufficiently enter the stable state.

FIGS. 24A to 24D, 25A to 25D and 26A to 26D are diagrams showing examples in which two pixels are to be replaced in the VA mode. FIGS. 24A to 24D are diagrams, showing an example in which the tilt azimuth angle θb is 45°, FIGS. 25A to 25D are diagrams showing an example in which the tilt azimuth angle θb is 90°, and FIGS. 26A to 26D are diagrams showing an example in which the tilt azimuth angle θb is 225°, wherein only the horizontal direction is assumed as the movement direction of the image pattern.

When the level darker than the grayscale level "c" is designated to the dark pixel being in contact with the extracted risk boundary, the replacement unit 314 replaces the video signal Vid-d with the video signal of the grayscale level "c".

Figure 24A:
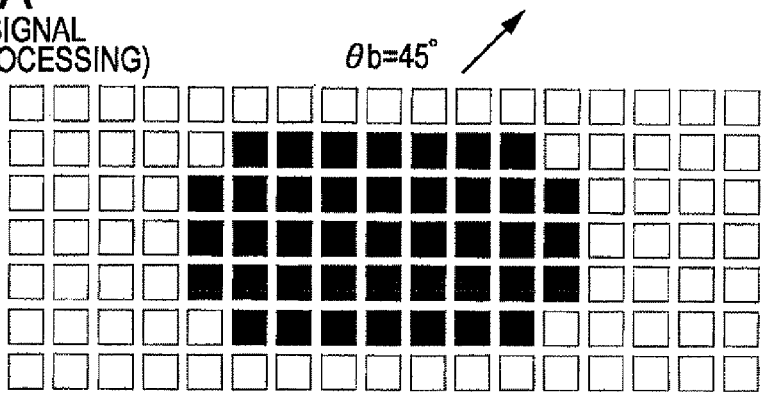
FIGS. 24A to 24D are diagram showing a replacement process when the horizontal direction is employed as the movement direction.
Figure 24B:
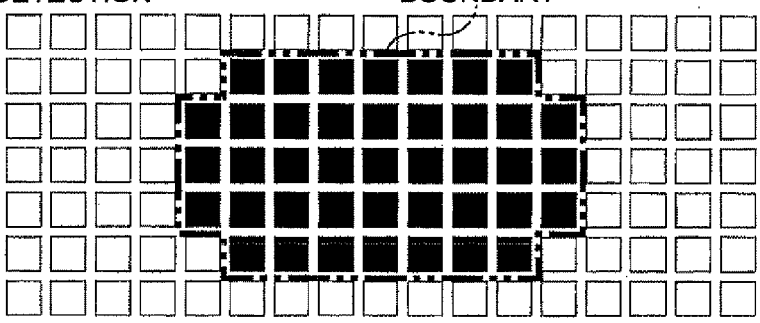
Figure 24C:
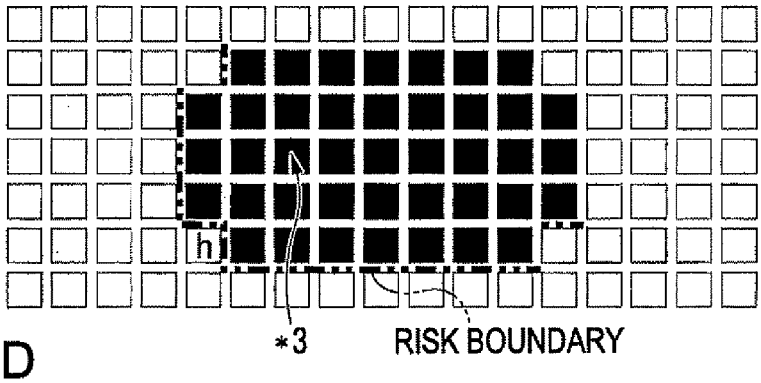
Figure 24D:
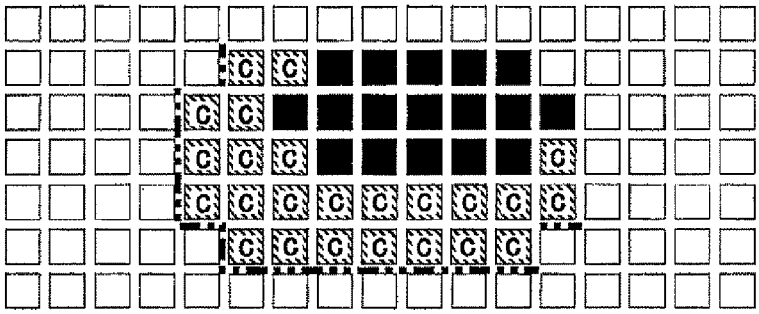
Figure 25A:
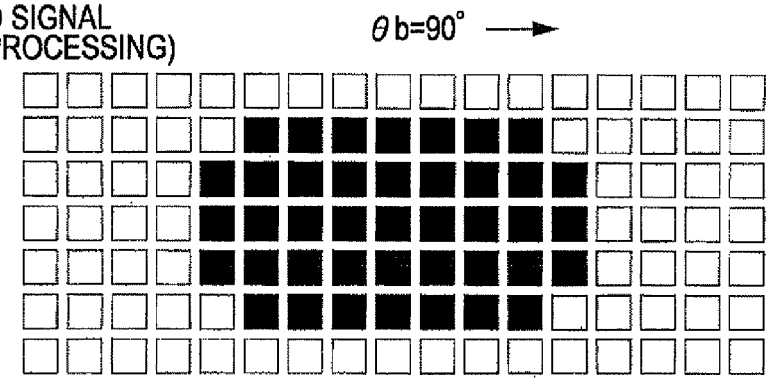
FIGS. 25A to 25D are diagram showing a replacement process when the horizontal direction is employed as the movement direction.
Figure 25B:
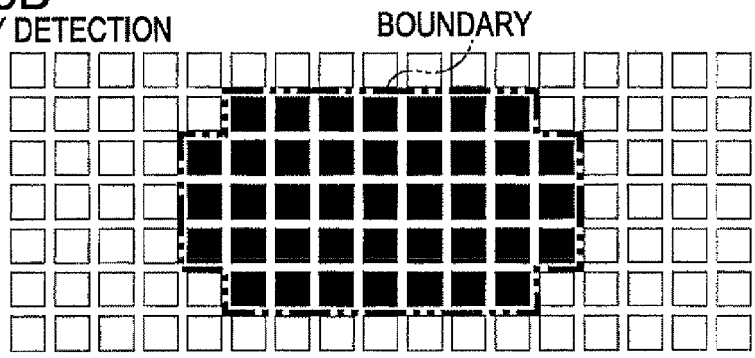
Figure 25C:
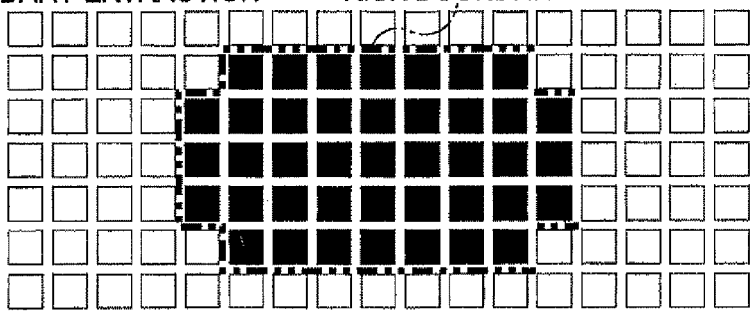
Figure 25D:
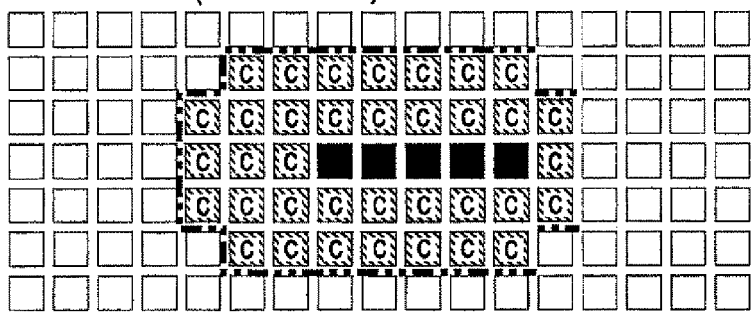
Figure 26A:
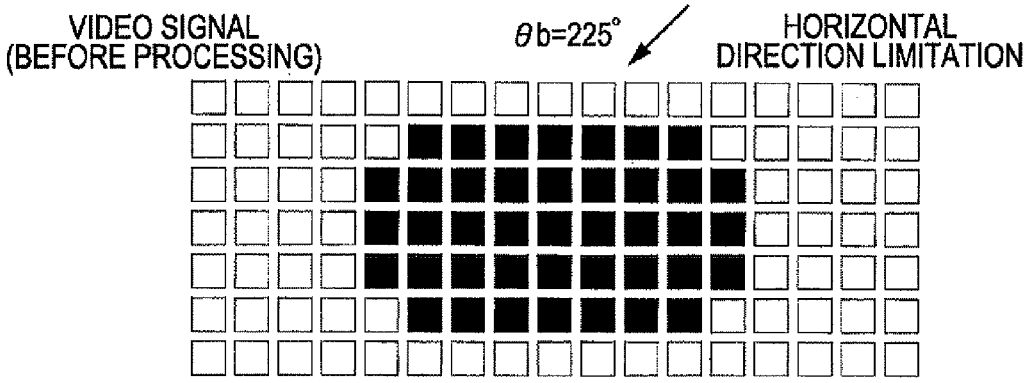
FIGS. 26A to 26D are diagram showing a replacement process when the horizontal direction is employed as the movement direction.
Figure 26B:
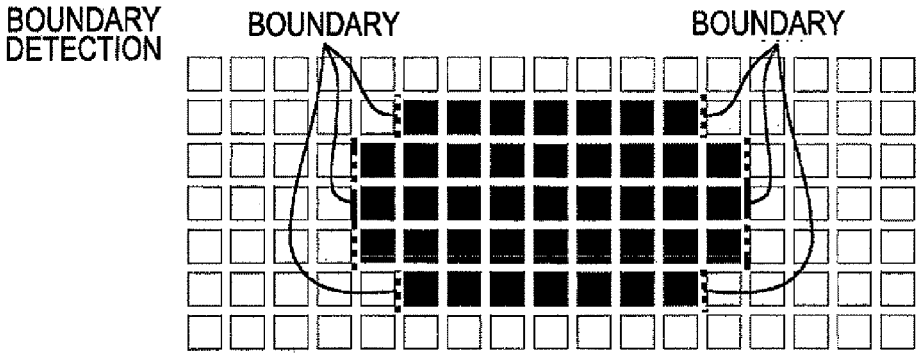
Figure 26C:
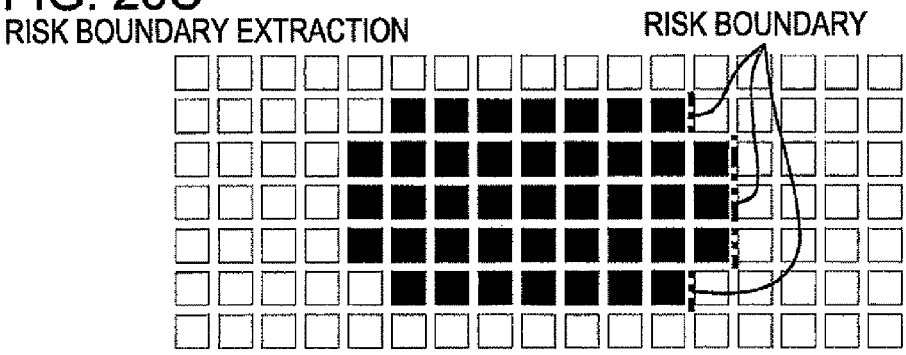
Figure 26D:
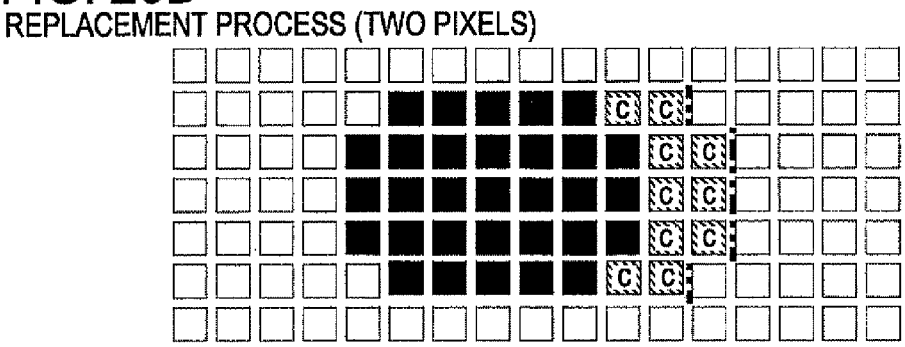

In addition, in FIG. 24C, in order to deal with the case in which a pattern corresponding to a white display pixel h moves by two pixels in the upwardly inclined direction on the right side, the black pixel indicated by *3 is exceptionally treated as a pixel located in the direction opposite to that of the risk boundary with respect to the pixel being contact with the risk boundary.

Furthermore, if 2S<T≤3S, it is preferred that pixels receiving the applied voltage to be replaced includes the total three pixels, that is, a pixel being in contact with the risk boundary, and two pixels continuous in the direction opposite to that of the risk boundary when employing the pixel being an contact with the risk boundary as a starting point.

In general, for the number of pixels receiving the applied voltage to be replaced, it is preferred to use a value (an addition value) obtained by adding "1" to an integer part of a value obtained by dividing the response time T by the time interval S.

However, since the number of pixels being in, contact with the risk boundary is necessarily "1" regardless of the response time T, it is reasonable that pixels being in contact with the risk boundary are excluded. Thus, for the number (i.e., the number of added pixels to be replaced) of pixels continuous toward the direction opposite to that of the risk boundary, if S<T, it is preferred to use a value of an integer part of a value obtained by dividing the response time T by the time interval S.

Herein, if a large number of pixels to be replaced is set, the grayscale level designated by the video signal vid-in may be unnecessarily replaced. Meanwhile, if a small number of pixels to be replaced is set, the unstable state of the liquid crystal molecules may be continuous at the time of the next update (rewriting).

However, in recent years, the liquid crystal panel 100 has operated at a high speed such as double speed or quad speed. Meanwhile, in the case of such a high speed driving, the video signal Vid-in supplied from the upper apparatus corresponds to one coma in each frame similarly to constant speed driving. In this regard, in order to improve moving picture display visibility characteristics and the like between the n frame and the (n+1) frame, a case may occur in which an intermediate image of both frames is generated by an interpolation technology and the like and is displayed on the liquid crystal panel 100. For example, in the case of double speed driving, an update time interval of a display screen is 8.35 milliseconds corresponding to ½ of 16.7 milliseconds. Thus, each frame is divided into two fields such as a first field and a second field. In the first field, for example, an update operation is performed to display an image of a subject frame. In the second field, an update operation is performed to display an interpolation image corresponding to the image of the subject frame and an image of the subsequent frame.

Consequently, in the case of high speed driving, in the fields obtained by dividing the frame, a case may occur in which an image pattern moves by one pixel.

In the case in which a time of a frame for which the video signal Vid-in corresponding to one coma is supplied is defined as F (milliseconds), when a liquid crystal panel is driven at a U speed (U is an integer), a time of one field is obtained by dividing F by U, and serves as the time interval S for which the display screen is updated.

Thus, for example, when the liquid crystal panel 100 is driven at double speed with respect to the video signal Vid-in for which one frame is supplied at 16.7 milliseconds, the time interval S for which the display screen is updated is 8.35 milliseconds corresponding to ½ of 16.7 milliseconds. Herein, if the response time T is temporarily 24 milliseconds, the preferred number of pixels to be replaced is "3" because a value "2.874" is obtained by dividing "24" by "8.35" and "1" is added to an integer part "2" of this value. In addition, when excluding pixels being in contact with the risk boundary, the number (the number of added pixels) of pixels continuous in the direction opposite to that of the risk boundary is the integer part "2".

In the above description, the video signal Vid-in is for designating the grayscale level of a pixel. However, the video signal Vid-in may directly designate the applied voltage of the liquid crystal element. When the video signal Vid-in designates the applied voltage of the liquid crystal element, it is preferred to employ a configuration in which a boundary is determined by the designated applied voltage and a voltage is corrected.

Furthermore, the liquid crystal element 120 is not limited to a transmission type. For example, the liquid crystal element 120 may be a reflection type.

Electronic Apparatus

Figure 27:
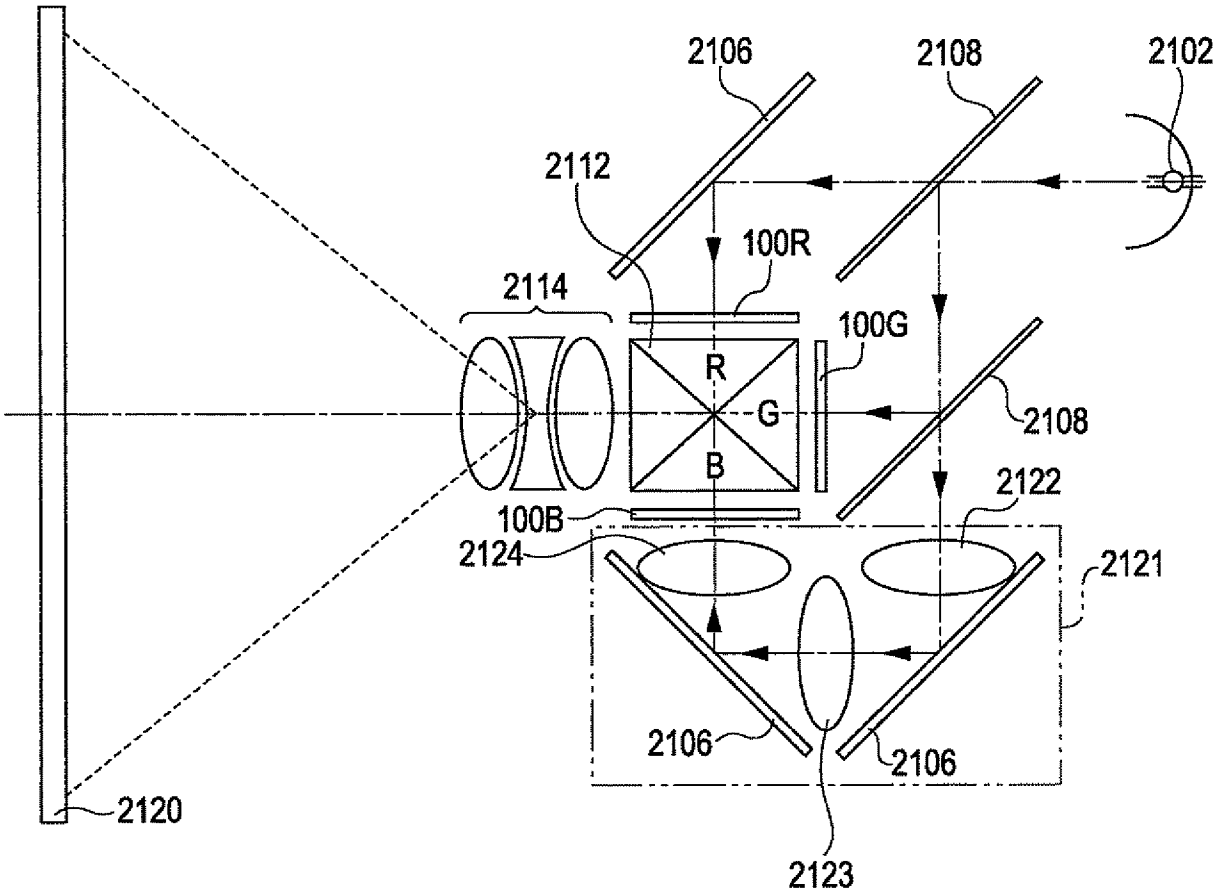
FIG. 27 is a diagram showing a projector to which a liquid crystal display apparatus is applied.

Next, as an example of an electronic apparatus using the liquid crystal display apparatus according to the embodiment as described above, a projection type display apparatus (a projector) using the liquid crystal panel 100 as a light bulb will be described. FIG. 27 is a plan view showing the configuration of the projector.

As shown in FIG. 27, the projector 2100 has a lamp unit 2102 is provided therein with a white light source such as a halogen lamp. A projection light emitted from the lamp unit 2102 is divided into the three primary colors of R (red), G (green) and B (blue) by three mirrors 2106 and two dichroic mirrors 2108, which are disposed in the projector 2100, and is guided to light bulbs 100R, 100G and 100B corresponding to the three primary colors, respectively. In addition, since a light of B color has a light path longer than those of a light of R color or G color, the light of B color is guided through a relay lens system 2121 including an incident lens 2122, a relay lens 2123 and an outgoing lens 2124 in order to prevent loss thereof.

In the projector 2100, three liquid crystal display apparatuses including the liquid crystal panels 100 are provided corresponding to the RGB colors. The configurations of the light bulbs 100R, 100G and 100B are the same as that of the liquid crystal panel 100. Video signals are supplied from an external upper circuit in order to designate the grayscale levels of the primary color components of the RGB colors, so that the light bulbs 100R, 100G and 100B are driven. Lights modulated by the light bulbs 100R, 100G and 100B are incident into a dichroic prism 2112 from three directions. In the dichroic prism 2112, the lights of R color and B color are refracted at 90° and the light of G color goes straight ahead.

Consequently, after images of the primary colors are synthesized, a color image is projected onto a screen 2120 by a projection lens group 2114.

In addition, since the lights corresponding to the ROB colors are incident into the light bulbs 100R, 100G and 100B by the dichroic mirrors 2108, it is not necessary to provide color filters. Furthermore, since transmission images of the light bulbs 100R and 100B are projected after being reflected by the dichroic prism 2112 whereas a transmission image of the light bulb 100G is projected as is, horizontal scanning directions through the light bulbs 100R and 100B are opposite to a horizontal scanning direction through the light bulb 100G, resulting in the display of an image obtained by inverting the right and left of the horizontal direction.

In addition to the projector described with reference to FIG. 27, an electronic apparatus includes a television, a viewfinder type/monitor direct view type video tap recorder, a car navigation apparatus, a pager, an electronic organizer, a calculator, a word processor, a workstation, a television phone, a POS terminal, a digital still camera, a mobile phone, an apparatus provided with a touch panel, and the like. It goes without saying that the liquid crystal display apparatus can be applied to these various electronic apparatus.

The entire disclosure of Japanese Patent Application No. 2009-258795, filed Nov. 12, 2009 is expressly incorporated by reference herein.

What is claimed is:

1. A video processing circuit, which includes a liquid crystal panel provided with pixel electrodes provided on a first substrate, a common electrode provided on a second substrate, and liquid crystal elements having liquid crystal interposed between the pixel electrodes and the common electrode, and designates an applied voltage, which is applied to the liquid crystal elements, to the liquid crystal panel based on a video signal, the video processing circuit comprising:

a boundary detection unit that detects a specific boundary, which is a part of a boundary of a first pixel for which an applied voltage designated by the video signal is less than a first voltage, and a second pixel for which the applied voltage is more than a second voltage larger than the first voltage, the specific boundary being determined by tilt azimuth of the liquid crystal; and a replacement unit that replaces an applied voltage to a liquid crystal element corresponding to the first pixel with a predetermined voltage from the applied voltage designated by the input video signal when the applied voltage designated by the video signal is less than a third voltage smaller than the first voltage with respect to the first pixel adjacent to the specific boundary, wherein when an applied voltage designated by a video signal of the second pixel is less than the third voltage with respect to the first pixel adjacent to the specific boundary and at least one first pixel continuous to the first pixel, the replacement unit replaces an applied voltage to a liquid crystal element corresponding to the second pixel with the predetermined voltage from the applied voltage designated by the video signal, and when a time interval in which display of the liquid crystal panel is updated is defined as S and a response time of the liquid crystal element when an applied voltage is switched to the third voltage from a voltage less than the third voltage is defined as T, if $S<T$, the number of the at least one first pixel continuous to the first pixel adjacent to the specific boundary is a value of an integer part of a value obtained by dividing the response time T by the time interval S.

2. The video processing circuit according to claim 1, wherein the tilt azimuth is a direction toward the other end of a liquid crystal molecule from one end of a long axis of the liquid crystal molecule at a side of the pixel electrodes when viewed in a plan view toward the common electrode from the side of the pixel electrodes.

3. The video processing circuit according to claim 1, wherein the predetermined voltage is the third voltage.

4. The video processing circuit according to claim 3, wherein the third voltage is a voltage which is enough to give an initial inclination angle to liquid crystal elements.

5. The video processing circuit according to claim 3, wherein the third voltage is about 1.5V.

6. The video processing circuit according to claim 1, wherein the predetermined voltage is a voltage which is enough to give an initial inclination angle to liquid crystal molecules.

7. The video processing circuit according to claim 1, wherein the boundary detection unit detects the boundary by comparing an input video signal with a signal obtained by delaying the input video signal by one pixel.

8. A video processing method, which includes a liquid crystal panel provided with pixel electrodes provided on a first substrate, a common electrode provided on a second substrate, and liquid crystal elements having liquid crystal interposed between the pixel electrodes and the common electrode, and designates an applied voltage, which is applied to the liquid crystal elements, to the liquid crystal panel based on a video signal, the video processing method comprising:

detecting a specific boundary, which is a part of a boundary of a first pixel for which an applied voltage designated by the video signal is less than a first voltage, and a second pixel for which the applied voltage is more than a second voltage larger than the first voltage, the specific boundary being determined by tilt azimuth of the liquid crystal;

extracting a part, in which dark pixels are located at an upper side and bright pixels are located at a lower side, and a part, in which the dark pixels are located at a right side and the bright pixels are located at a left side; and replacing an applied voltage to a liquid crystal element corresponding to the first pixel with a predetermined voltage from the applied voltage designated by the input video signal when the applied voltage designated by the video signal is less than a third voltage smaller than the first voltage with respect to the first pixel adjacent to the specific boundary, wherein when an applied voltage designated by a video signal of the second pixel is less than the third voltage with respect to the first pixel adjacent to the specific boundary and at least one first pixel continuous to the first pixel, replacing an applied voltage to a liquid crystal element corresponding to the second pixel with the predetermined voltage from the applied voltage designated by the video signal, and when a time interval in which display of the liquid crystal panel is updated is defined as S and a response time of the liquid crystal element when an applied voltage is switched to the third voltage from a voltage less than the third voltage is defined as T, if S<T, the number of the at least one first pixel continuous to the first pixel adjacent to the specific boundary is a value of an integer part of a value obtained by dividing the response time T by the time interval S.

9. A liquid crystal display apparatus, which includes a liquid crystal panel provided with pixel electrodes provided on a first substrate, a common electrode provided on a second substrate, and liquid crystal elements having liquid crystal interposed between the pixel electrodes and the common electrode, and a video processing circuit that designates an applied voltage, which is applied to the liquid crystal elements, based on a video signal, the video processing circuit comprising:

a boundary detection unit that detects a specific boundary, which is a part of a boundary of a first pixel for which an applied voltage designated by the video signal is less than a first voltage, and a second pixel for which the applied voltage is more than a second voltage larger than the first voltage, the specific boundary being determined by tilt azimuth of the liquid crystal;

the boundary detection unit including a first detection section, a second detection section, and a determination section, the second detection section extracting a part, in which dark pixels are located at an upper side and bright pixels are located at a lower side, and a part, in which the dark pixels are located at a right side and the bright pixels are located at a left side; and a replacement unit that replaces an applied voltage to a liquid crystal element corresponding to the first pixel with a predetermined voltage from the applied voltage designated by the input video signal when the applied voltage designated by the video signal is less than a third voltage smaller than the first voltage with respect to the first pixel adjacent to the specific boundary, wherein when an applied voltage designated by a video signal of the second pixel is less than the third voltage with respect to the first pixel adjacent to the specific boundary and at least one first pixel continuous to the first pixel, the replacement unit replaces an applied voltage to a liquid crystal element corresponding to the second pixel with the predetermined voltage from the applied voltage designated by the video signal, and when a time interval in which display of the liquid crystal panel is updated is defined as S and a response time of the liquid crystal element when an applied voltage is switched to the third voltage from a voltage less than the third voltage is defined as T, if S<T, the number of the at least one first pixel continuous to the first pixel adjacent to the specific boundary is a value of an integer art of a value obtained by dividing the response time T by the time interval S.

10. An electronic apparatus including the liquid crystal display apparatus according to claim 9.

11. A signal processing device which is used in a liquid crystal apparatus including a plurality of pixels, comprising:

a first detection portion that detects a first boundary between a first pixel and a second pixel, wherein the first pixel is correlated with a first signal for displaying a first grayscale level lower than a first reference grayscale level, wherein the second pixel is correlated with a second signal for displaying a second grayscale level higher than a second reference grayscale level, and wherein the second reference grayscale level is higher than the first reference grayscale level, a second detection portion that detects a second boundary which is determined by tilt azimuth of the liquid crystal from the first boundary; and a correction portion that corrects the first signal to a third signal for displaying a third grayscale level lower than the first reference grayscale level and higher than or equal to a third reference grayscale level lower than the first reference grayscale level, if the first pixel is adjacent to the second boundary and the first grayscale level is lower than the third reference grayscale level, wherein when an applied voltage designated by a video signal of the second pixel is less than a third voltage with respect to the first pixel adjacent to a specific boundary and at least one first pixel continuous to the first pixel, a replacement unit replaces an applied voltage to a liquid crystal element corresponding to the second pixel with a predetermined voltage from the applied voltage designated by the video signal, and when a time interval in which display of a liquid crystal panel is updated is defined as S and a response time of the liquid crystal element when an applied voltage is switched to the third voltage from a voltage less than the third voltage is defined as T, if S<T, the number of the at least one first pixel continuous to the first pixel adjacent to the specific boundary is a value of an integer part of a value obtained by dividing the response time T by the time interval S.

12. A signal processing device which is used in a liquid crystal apparatus including a plurality of pixels, comprising:

a first detection portion that detects a first signal, correlated with a first pixel, for applying a first voltage lower than a first reference voltage, and a second signal, correlated with a second pixel adjacent to the first pixel, for applying a second voltage higher than a second reference voltage on the basis of a signal for controlling a voltage applied to each of the plurality of pixels;

a second detection portion that detects a third pixel which is determined by tilt azimuth of the liquid crystal from the first pixel; and a correction portion that corrects the first signal, correlated with the third pixel, to a third signal for applying a third voltage lower than the first reference voltage and higher than or equal to a third reference voltage lower than the first reference voltage, if the first voltage is lower than the third reference voltage, wherein when an applied voltage designated by a video signal of the second pixel is less than a third voltage with respect to the first pixel adjacent to a specific boundary and at least one first pixel continuous to the first pixel, a replacement unit replaces an applied voltage to a liquid crystal element corresponding to the second pixel with a predetermined voltage from the applied voltage designated by the video signal, and when a time interval in which display of a liquid crystal panel is updated is defined as S and a response time of the liquid crystal element when an applied voltage is switched to the third voltage from a voltage less than the third voltage is defined as T, if S<T, the number of the at least one first pixel continuous to the first pixel adjacent to the specific boundary is a value of an integer part of a value obtained by dividing the response time T by the time interval S.

13. A signal processing device which is used in a liquid crystal apparatus including a plurality of pixels, comprising:

a first detection portion that detects a first signal, correlated with a first pixel, for displaying a first grayscale level lower than a first reference grayscale level, and a second signal, correlated with a second pixel adjacent to the first pixel, for displaying a second grayscale level higher than a second reference grayscale level on the basis of a signal for controlling a grayscale level displayed to each of the plurality of pixels;

a second detection portion that detects a third pixel which is determined by tilt azimuth of the liquid crystal from the first pixel; and a correction portion that corrects the first signal, correlated with the third pixel, to a third signal for displaying a third grayscale level lower than the first reference grayscale level and higher than or equal to a third reference grayscale level lower than the first reference grayscale level, if the first grayscale level is lower than the third reference grayscale level, wherein when an applied voltage designated by a video signal of the second pixel is less than a third voltage with respect to the first pixel adjacent to a specific boundary and at least one first pixel continuous to the first pixel, a replacement unit replaces an applied voltage to a liquid crystal element corresponding to the second pixel with a predetermined voltage from the applied voltage designated by the video signal, and when a time interval in which display of a liquid crystal panel is updated is defined as S and a response time of the liquid crystal element when an applied voltage is switched to the third voltage from a voltage less than the third voltage is defined as T, if S<T, the number of the at least one first pixel continuous to the first pixel adjacent to the specific boundary is a value of an integer part of a value obtained by dividing the response time T by the time interval S.

* * * * *